US008690707B2

(12) United States Patent
Stites et al.

(10) Patent No.: US 8,690,707 B2
(45) Date of Patent: Apr. 8, 2014

(54) GOLF CLUBS AND GOLF CLUB HEADS WITH ADJUSTABLE CENTER OF GRAVITY AND MOMENT OF INERTIA CHARACTERISTICS

(75) Inventors: John Thomas Stites, Weatherford, TX (US); Robert Boyd, Euless, TX (US); David N. Franklin, Granbury, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/184,846

(22) Filed: Jul. 18, 2011

(65) Prior Publication Data

US 2011/0275454 A1 Nov. 10, 2011

Related U.S. Application Data

(62) Division of application No. 12/016,114, filed on Jan. 17, 2008, now Pat. No. 7,988,568.

(51) Int. Cl.
*A63B 53/06* (2006.01)

(52) U.S. Cl.
USPC ..... 473/335; 473/350

(58) Field of Classification Search
USPC ..... 473/334–339, 350
See application file for complete search history.

(56) References Cited

U.S. PATENT DOCUMENTS

| | | | | |
|---|---|---|---|---|
| 4,811,950 | A | 3/1989 | Kobayashi | |
| 4,869,507 | A * | 9/1989 | Sahm | 473/337 |
| 5,297,794 | A | 3/1994 | Lu | |
| 5,429,356 | A * | 7/1995 | Dingle et al. | 473/251 |
| 5,722,177 | A | 3/1998 | Reilly, III | |
| 5,916,042 | A * | 6/1999 | Reimers | 473/334 |
| 6,015,354 | A * | 1/2000 | Ahn et al. | 473/256 |
| 6,692,371 | B2 | 2/2004 | Berish et al. | |
| 6,991,555 | B2 | 1/2006 | Reese | |
| 7,147,573 | B2 * | 12/2006 | DiMarco | 473/324 |
| 7,156,752 | B1 | 1/2007 | Bennett | |
| 7,204,765 | B2 | 4/2007 | Cover et al. | |

(Continued)

FOREIGN PATENT DOCUMENTS

| | | |
|---|---|---|
| CN | 2922962 | 7/2007 |
| EP | 1 752 198 | 2/2007 |
| WO | 2007/101350 | 9/2007 |
| WO | 2008008175 | 1/2008 |

OTHER PUBLICATIONS

Feb. 22, 2012 Office Action issued in related Chinese Application No. 200980105482.4.

(Continued)

*Primary Examiner* — Stephen L. Blau
(74) *Attorney, Agent, or Firm* — Banner & Witcoff, Ltd.

(57) ABSTRACT

Golf clubs, club heads, and club weighting systems may include: (a) a club head body member; and (b) one or more weight members movably engaged with the club head body member so as to move between a first position and a second position to change an overall exterior shape of the club head. This shape change may result in changes to the overall center of gravity, weighting, and/or moment of inertia characteristics of the club head. Alternatively or additionally, the weight member(s) may be removed from the club head body member, reoriented, and/or replaced with a different weight member, e.g., to change the overall exterior shape, center of gravity, weighting, and/or moment of inertia characteristics of the club head. Methods of making and using these clubs, club heads, and weighting systems also are described.

12 Claims, 14 Drawing Sheets

(56) References Cited

U.S. PATENT DOCUMENTS

| | | | | |
|---|---|---|---|---|
| 7,404,772 | B2 | 7/2008 | Koide et al. | |
| 7,520,820 | B2 * | 4/2009 | Dimarco | 473/334 |
| 7,566,276 | B2 | 7/2009 | Billings | |
| 7,749,100 | B2 | 7/2010 | Tavares | |
| 2004/0176177 | A1 * | 9/2004 | Mahaffey et al. | 473/256 |
| 2004/0214657 | A1 | 10/2004 | Hou | |
| 2005/0009625 | A1 * | 1/2005 | Stites et al. | 473/338 |
| 2005/0137024 | A1 * | 6/2005 | Stites et al. | 473/291 |
| 2006/0035717 | A1 | 2/2006 | Cover et al. | |
| 2006/0172816 | A1 * | 8/2006 | Johnson | 473/334 |
| 2006/0240907 | A1 | 10/2006 | Latiri | |
| 2007/0155534 | A1 | 7/2007 | Tsai et al. | |
| 2007/0178988 | A1 * | 8/2007 | Tavares et al. | 473/334 |
| 2007/0207878 | A1 | 9/2007 | Tavares et al. | |
| 2007/0225085 | A1 | 9/2007 | Koide et al. | |
| 2007/0265109 | A1 | 11/2007 | Elmer | |
| 2008/0015051 | A1 | 1/2008 | Roach et al. | |
| 2008/0020861 | A1 * | 1/2008 | Adams et al. | 473/334 |
| 2008/0045354 | A1 * | 2/2008 | Drew | 473/337 |
| 2008/0132353 | A1 | 6/2008 | Hsiao | |
| 2008/0139336 | A1 * | 6/2008 | Dimarco | 473/335 |
| 2008/0146370 | A1 | 6/2008 | Beach et al. | |
| 2008/0242444 | A1 | 10/2008 | Park et al. | |
| 2008/0261715 | A1 | 10/2008 | Carter | |
| 2009/0186717 | A1 | 7/2009 | Stites et al. | |

OTHER PUBLICATIONS

Feb. 29, 2012 Office Action issued in related U.S. Appl. No. 12/576,688.

International Search Report and Written Opinion issued in related International Application No. PCT/US2010/050196, mailed Jan. 11, 2011.

International Preliminary Report on Patentability issued in related International Application No. PCT/US2009/030251, mailed Jul. 29, 2010.

International Search Report in related International Application No. PCT/US2009/030251, mailed Apr. 15, 2009.

Jul. 20, 2012 Office Action issued in related U.S. Appl. No. 12/576,688.

English translation of Dec. 5, 2012 Office Action issued in Japanese Application No. 2010-543158.

English translation of Nov. 28, 2012 Office Action issued in Chinese Application No. 200980105482.4.

European Office Action dated Mar. 4 2013 issued in European Application No. 09702390.7.

Notice of Reasons for Rejection (with English translation) dated Oct. 23, 2013 for JP Application No. 2012-533203.

* cited by examiner

FIG. 7A
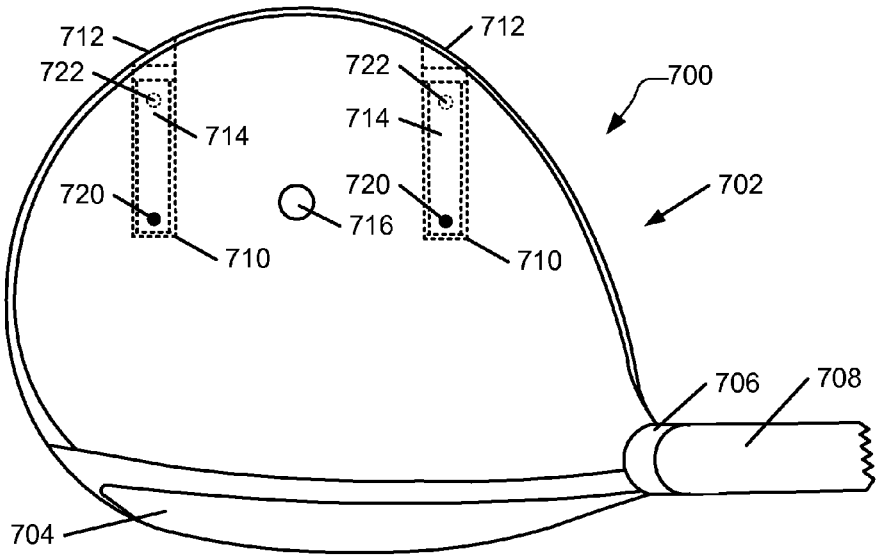
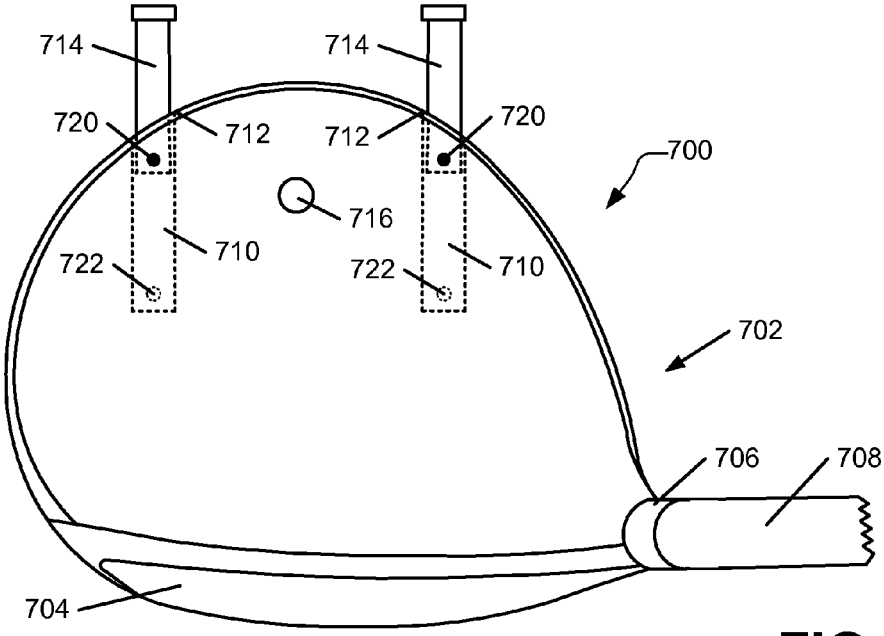
FIG. 7B

FIG. 8A
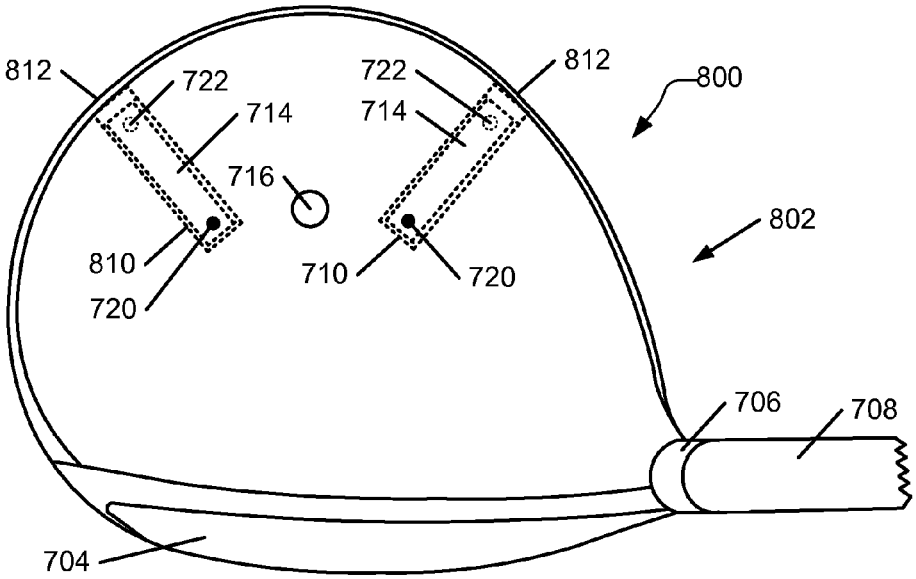
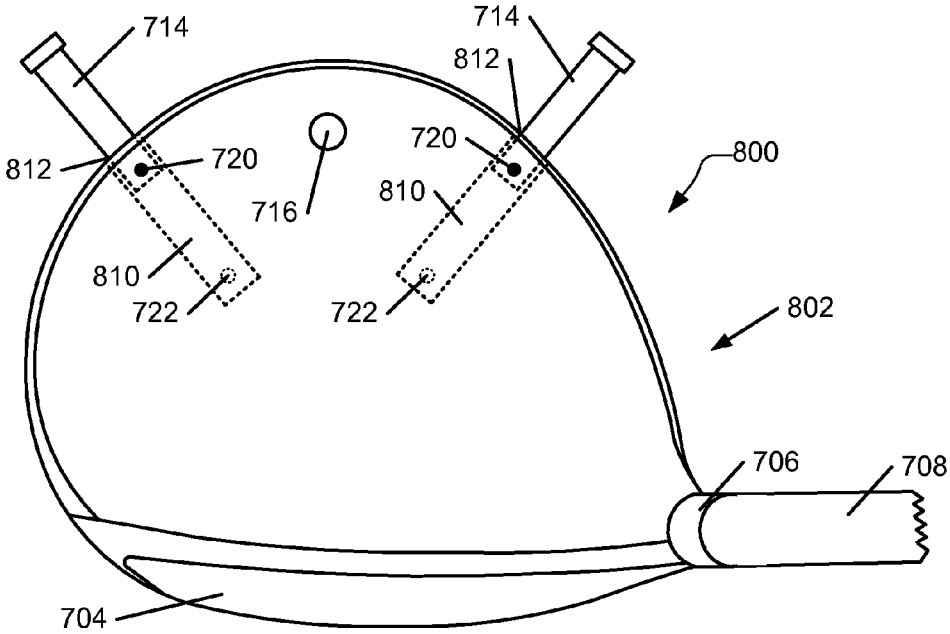
FIG. 8B

GOLF CLUBS AND GOLF CLUB HEADS WITH ADJUSTABLE CENTER OF GRAVITY AND MOMENT OF INERTIA CHARACTERISTICS

CROSS-REFERENCE TO RELATED APPLICATION

This application is a divisional application of U.S. patent application Ser. No. 12/016,114, filed Jan. 17, 2008, entitled "Golf Clubs and Golf Club Heads with Adjustable Center of Gravity and Moment of Inertia Characteristics", the disclosure of which is hereby incorporated by reference in its entirety and made part hereof.

FIELD OF THE INVENTION

This invention relates to golf clubs, golf club heads, and methods for making and using golf clubs and golf club heads.

BACKGROUND

Various golf club heads and golf club products have been designed to improve a golfer's accuracy by assisting the golfer in squaring the club head face at impact with a golf ball. For example, a number of golf club heads have weight strategically positioned in order to alter the location of the club head's center of gravity and/or to increase the club head's moment of inertia (e.g., resistance to twisting). The location of the center of gravity of the club head and its degree of twist at impact are factors that, at least in part, determine whether a golf ball will be propelled in the intended direction when struck. When the center of gravity is positioned behind the ball's point of engagement on the contact surface and the club head is square to the intended target line, the golf ball generally will follow a straight route. When the center of gravity is spaced to a side of the ball's point of engagement and/or the club head is not square at impact, however, the golf ball may follow a route that curves left or right, or it may simply fly to the left or right, ball flights often referred to as "draws," "fades," "hooks," "slices," "pulls," or "blocks." Similarly, when the center of gravity of the club head is spaced above or below the point of engagement with the ball, the flight of the golf ball may exhibit more boring or climbing trajectories, respectively. Proper and consistently repeatable golf ball striking can be quite difficult and frustrating to achieve, particularly for beginning players, youngsters, or occasional recreational players.

Golf club heads, such as cavity back and/or perimeter weighted club heads, assist some golfers by locating much of the weight of the club head around the club head's perimeter. Generally, these golf club heads are more "forgiving" than non-cavity, non-perimeter weighted golf club heads, thereby allowing a golf ball to be struck somewhat off center or otherwise mis-hit, while still providing relatively good distance and accuracy. Cavity back and/or perimeter weighted club heads have helped the average golfer reduce mis-hits and improve scoring.

While golf club technology has improved in recent years, there remains room in the art for still further advances and improvements in golf club technology. Additionally, there is room in the art for improvements to golf clubs for use by youngsters, beginners, and/or high handicappers, e.g., to help them develop and improve their game and make the ball easier for them to hit more consistently and accurately.

SUMMARY OF THE INVENTION

This invention relates to golf club heads, golf club weighting systems, and golf clubs including such golf club heads and/or golf club weighting systems, e.g., including putters, irons, hybrids, and woods. Golf club heads and/or golf club weighting systems according to at least some example aspects of this invention may include: (a) a club head body member; and (b) one or more weight members movably engaged with the club head body member so as to move between a first position and a second position (e.g., by sliding, rotating, etc.) to change an overall exterior shape of the club head (e.g., and thereby change the overall center of gravity, weighting, and/or moment of inertia characteristics of the club head). The movement of the weight member may change the exterior shape of the club head to extend the club head structure in the rearward, heel, and/or toe direction(s); change the perimeter shape of the club head structure, particularly in the rearward, heel, and/or toe direction(s); and/or move the center of gravity in the rearward, heel, and/or toe direction(s). The clubs may be used with the various weight members arranged in any of their potential positions.

If desired, the weight member may take the form and/or appearance of a portion of the overall club head body member. The club head may be used to hit balls with the weight member(s) secured at either the first or second position. Alternatively or additionally, if desired in at least some examples of this invention, one or more of the weight members may be removed from the club head body member, reoriented in a different manner (to thereby change the overall exterior shape, center of gravity, weighting, and/or moment of inertia characteristics of the club head), and/or replaced with a different weight member (which also may change the overall exterior shape, center of gravity, weighting, and/or moment of inertia characteristics of the club head). Golf clubs in accordance with at least some examples of this invention may include club heads and/or weighting systems of the types described above, along with a shaft member attached to the club head, a handle member integral with or attached to the shaft, and/or a grip member integral with or attached to the shaft.

Additional aspects of this invention relate to methods for making and/or using golf club heads and golf clubs with shape, center of gravity, weighting, and/or moment of inertia alteration capabilities, e.g., of the various types described above. Methods of making golf club heads in accordance with at least some examples of this invention may include: (a) providing a club head body member (e.g., making the club head body member, obtaining it from another source or supplier, etc.); and (b) movably engaging one or more weight members with the club head body member, wherein one or more of the weight members are engaged with the club head body member so as to be movable between a first position and a second position to thereby change an overall exterior shape of the club head (e.g., to thereby also change the center of gravity, weighting, and/or moment of inertia characteristics of the club head). Methods of making golf clubs in accordance with at least some example aspects of this invention may include: (a) providing a club head that includes a club head body member and at least one weight member engaged with the club head body member (e.g., making the club head, obtaining it from another source or supplier, etc.), wherein the at least one weight member is movable between a first position and a second position to change an overall exterior shape of the club head; and (b) engaging a shaft member with the club head. As noted above, if desired, the weight member may take the form or appearance of at least a portion of the overall club head body (at least at one of its mounting positions).

Still additional methods according to at least some examples of this invention relate to methods of changing weighting and/or moment of inertia characteristics of a golf club head. Such methods may include: (a) providing a club head body member including a weight engaging system (e.g., by making the body member, obtaining it from another source or supplier, etc.); and (b) changing an overall exterior shape of the club head by moving or changing a weight member engaged with the weight engaging system. Various ways of changing the overall exterior shape of the club head (and thus its center of gravity, weighting, and/or moment of inertia characteristics) may be used without departing from this invention. More specific examples include: (a) moving the weight member from a first position to a second position (e.g., by sliding it, rotating it, etc.); (b) moving and/or removing the weight member and reorienting at least a portion of it to another position; and/or (c) exchanging one weight member for another having a different size, shape, and/or orientation characteristics.

BRIEF DESCRIPTION OF THE DRAWINGS

The present invention is illustrated by way of example and not limited in the accompanying figures, in which like reference numerals indicate similar elements throughout, and in which:

FIGS. 7A and 7B illustrate example features of additional example golf clubs and golf club heads in accordance with this invention (again, wood-type golf clubs and golf club heads are illustrated); and FIGS. 8A and 8B illustrate example features of additional example golf clubs and golf club heads in accordance with this invention (again, wood-type golf clubs and golf club heads are illustrated).

DETAILED DESCRIPTION

Figure 1A:
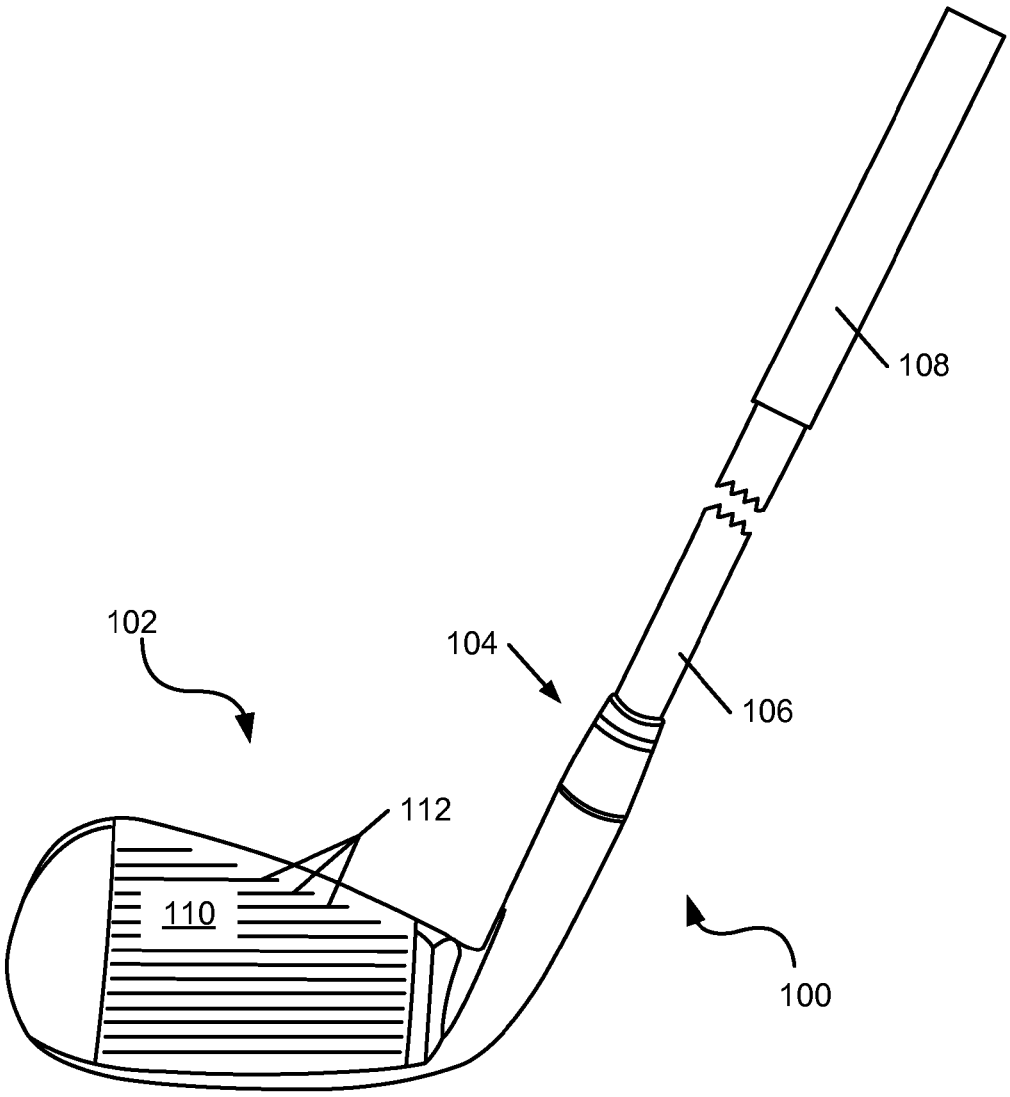
FIGS. 1A through 1E illustrate example features of example golf clubs and golf club heads in accordance with this invention (iron-type golf clubs and golf club heads are illustrated)

The following description and the accompanying figures disclose various example features of golf clubs and golf club heads in accordance with the present invention (e.g., woods, irons, hybrids, putters, etc.).

I. General Description of Aspects of the Invention

A. Golf Club Heads and Golf Clubs

Aspects of this invention relate to golf club heads and golf clubs including such golf club heads, including putter heads, putters, iron-type club heads, iron-type golf clubs, wood-type golf club heads, and wood-type golf clubs. Golf club heads according to at least some example aspects of this invention may include: (a) a club head body member (e.g., including one or more individual parts, such as one or more parts forming a ball striking face, a sole, a crown, and/or a body of the club head); and (b) one or more weight members engaged with the club head body member. The weight member(s) may be movably engaged with the club head body member so as to move between a first position and a second position, to change an overall exterior or perimeter shape of the club head. The movement of the weight member may change the exterior or perimeter shape of the club head to extend the club head structure in the rearward, heel, and/or toe direction(s); change the perimeter shape of the club head structure, particularly in the rearward, heel, and/or toe direction(s); and/or move the center of gravity in the rearward, heel, and/or toe direction(s).

In at least some examples of this invention, the weight member(s) may be removed from or moved with respect to the club head body member and reoriented in a different manner (to thereby change the overall exterior shape of the club head) or it (they) may be replaced with a different weight member(s) (which also may change the overall exterior or perimeter shape of the club head). Movement between the first and second positions and/or otherwise changing the weight member(s) and/or their orientation may be used to change the overall shape of the club head body member, which in turn may be used to change (and control) the overall center of gravity, weighting, and/or moment of inertia characteristics of the club head. Weight members may be produced in any desired size, shape, and form without departing from the invention, e.g., to produce the ultimately desired club head shape, weighting, center of gravity, and/or moment of inertia characteristics. In some examples, the weight member(s) may form or appear as an integral and/or continuous part of the overall club head structure, at least in some positions.

Golf clubs in accordance with examples of this invention may include club heads, e.g., of the types described above, along with one or more of a shaft member attached to the club head (e.g., directly engaged, extending into, via a hosel element, etc.), a handle member integral with or attached to the shaft, a grip member integral with or attached to the shaft or handle member, etc.

Weight members may move with respect to the club head body member to change the overall exterior shape of the club head structure in any manner without departing from the invention. In accordance with at least some examples of this invention, the weight member(s) may be rotatably engaged with the club head body member to pivot between the first position and the second position (e.g., via a hinge or axle type element, etc.). In other examples, the weight member(s) may be slidably engaged with the club head body member to move between the first position and the second position (e.g., slidably mounted on a rail extending from the club head body member or the weight member, sliding into a receptacle (e.g., groove or slot) defined in the club head body member or the weight member, etc.). As still another example, the weight member(s) may be movably mounted with respect to the club head body member by releasably securing it (them) to the body member, e.g., with a threaded arrangement; a set screw; a pin member; a spring-loaded securing mechanism; one or more retaining detents, grooves, or other retaining elements; mounted on a raised boss element; etc.

In the first position, the weight member(s) in at least some example structures according to the invention may extend from the club head body member in a direction at least partially toward a front of the club head body member. In contrast, at the second position, these weight member(s) may extend from the club head body member in a direction at least partially away from the front of the club head body member. The weight member(s) also may take on any desired form without departing from the invention, such as a bridge member (e.g., extending across a rear cavity of an iron or putter type structure), a weighted body portion, a weight element secured to a club head body component, etc. Also, the weight member(s) may be movable with respect to the club head body member in a variety of different ways and a variety of different directions without departing from this invention, including, for example, one or more of: in a front-to-rear direction with respect to the club head body member (e.g., by sliding, rolling, rotating, etc.); in a heel-to-toe direction with respect to the club head body member (e.g., by sliding, rolling, rotating, etc.); at an acute angle with respect to the front-to-rear direction; etc.

B. Golf Club Weighting Systems

Additional aspects of this invention relate to golf club weighting systems, e.g., that may be used to control or change various physical characteristics of the golf club head, such as its overall external appearance; its center of gravity, weighting, and/or moment of inertia characteristics; etc. Golf club head weighting systems according to at least some examples of this invention may include: (a) a club head body member including a weight engaging system for releasably engaging a weight member; (b) a first weight member including a first club head engaging system for releasably engaging the club head body member, wherein the first weight member, when attached to the club head body member, provides at least a portion of a first overall exterior or perimeter shape to the club head; and (c) a second weight member including a second club head engaging system for releasably engaging the club head body member, wherein the second weight member, when attached to the club head body member, provides at least a portion of a second overall exterior or perimeter shape to the club head that differs from the first overall exterior or perimeter shape. Different weight members may be selected for use with the club head body member, e.g., to provide different exterior or perimeter shapes, center of gravity characteristics, weighting characteristics, and/or moment of inertia characteristics to the club head.

As additional and more specific examples, any of the various systems and methods of attaching weight members to a club head body, securing weight members to a club head body, moving weight members with respect to a club head body, disengaging weight members from a club head body, orienting weight members with respect to a club head body, and/or the like, including the various systems and methods described above, may be used without departing from the invention. Also, as above, any type of golf club head structure may be produced including weighting systems of the types described above without departing from this invention, including, for example: putter heads, iron-type golf club heads (e.g., iron-type hybrid clubs, zero through nine irons, sand wedges, pitching wedges, lob wedges, gap wedges, and the like), and wood-type golf club heads (drivers, fairway woods, wood-type hybrid clubs, etc.).

C. Methods

Still additional aspects of this invention relate to methods for making and/or using golf club heads and golf clubs in accordance with examples of this invention, e.g., of the various types described above. Methods of forming golf club heads in accordance with at least some examples of this invention may include: (a) providing a club head body member (e.g., by making it, obtaining it from an independent source or supplier, etc.); and (b) movably engaging one or more weight members with the club head body member, wherein one or more of the weight members are engaged with the club head body member so as to be movable between a first position and a second position to thereby change an overall exterior shape of the club head. Movement of the weight member(s) may be used, for example, to change the center of gravity, weighting, and/or moment of inertia characteristics of the club head.

The weight members may be movable with respect to the club head body member in any desired manner without departing from the invention, including: by rotating between the first position and the second position; by sliding between the first position and the second position; etc. Methods according to at least some examples of this invention further may include: securing the weight member in place with respect to the club head body member and/or moving the weight member between the first and second positions (e.g., in a front-to-rear direction, in a heel-to-toe direction, in an angled direction (e.g., with respect to the vertical, horizontal, heel-to-toe, and/or front-to-rear directions), in a rotational direction, in combinations of various different directions, etc.).

Methods of making golf clubs in accordance with at least some example aspects of this invention may include: (a) providing a club head (e.g., by making it, by obtaining it from an independent source or supplier, etc.), wherein the club head includes a club head body member and at least one weight member engaged with the club head body member, wherein the at least one weight member is movable between a first position and a second position to change an overall exterior shape of the club head; and (b) engaging a shaft member with the club head. The club head may be of any desired structure, such as the various structures described above. The shaft member additionally may include or be engaged with a handle member and/or a grip element.

Additional methods according to at least some examples of this invention relate to methods of changing weighting and/or moment of inertia characteristics of a golf club head. Such methods may include: (a) providing a club head body member including a weight engaging system (e.g., by making it, obtaining it from an independent source or supplier, etc.); (b) changing an overall exterior shape of the club head by moving or changing a weight member engaged with the weight engaging system; and/or (c) securing a weight member in place with respect to the club head body member. Various ways of changing the overall exterior shape of the club head may be used without departing from this invention. More specific examples include: (a) moving the weight member from a first position to a second position (e.g., by sliding it, rotating it, etc.); (b) moving and/or removing the weight member and reorienting at least a portion of it in another manner; and/or (c) by exchanging one weight member for another having a different size, shape, and/or orientation characteristics.

Given the general description of aspects of the invention provided above, more detailed descriptions of various specific examples of golf clubs and golf club head structures according to the invention are provided below.

II. Detailed Description of Example Golf Club Heads and Golf Club Structures According to the Invention

A. Example Iron-Type Golf Club Head Structures

FIGS. 1A through 1E generally illustrate a golf club 100 including features in accordance with at least some examples of this invention. As shown in FIG. 1A, the golf club 100 includes a club head 102, a hosel region 104, a shaft member 106 connected to the club head 102 via the hosel region 104, and a grip member 108 attached to the shaft member 106. The shaft member 106 may be made from any desired material(s), and it may be connected to the club head 102 in any desired manner, including from conventional materials and in conventional manners known and used in the art (e.g., constructed from one or more of metals, graphite, composite materials, etc., and attached via one or more of threads, mechanical connectors, cements, adhesives, etc.). Additionally, the grip member 108 may be made from any desired material(s), and it may be connected to or formed with the shaft member 106 in any desired manner, including from conventional materials and in conventional manners known and used in the art (e.g., constructed from one or more of rubber materials, leather, polymeric materials, cord-embedded rubber materials, etc., and attached via one or more of threads, mechanical connectors, cements, adhesives, etc.).

As further shown in FIG. 1A, the club head 102 includes a ball striking face 110, that may include grooves 112 formed therein for removing water, grass, and/or other materials from between a ball and the ball striking face 110 when the club 100 strikes a golf ball. The ball striking face 110 may be integrally formed as part of the overall club head body structure (e.g., machined from the remainder of the club head 102 to form the striking face 110), or it may be a separate element applied to the club head body (e.g., by welding or fusing techniques, by cements or adhesives, by mechanical connectors, etc.). Those skilled in the art will appreciate that a specific iron-type club head structure like that illustrated in FIGS. 1A through 1E may take on any desired form, loft angle, lie angle, bounce angle, offset characteristics, and the like without departing from the invention. For example, if desired, the golf club 100 and its corresponding club head 102 may form any of: a zero iron, a one iron, a two iron, a three iron, a four iron, a five iron, a six iron, a seven iron, an eight iron, a nine iron, a ten iron, a pitching wedge, a lob wedge, a gap wedge, a sand wedge, an iron-type "hybrid" club, etc., and have any desired flat, neutral, or upright lie angle or other characteristics without departing from the invention.

Figure 1B:
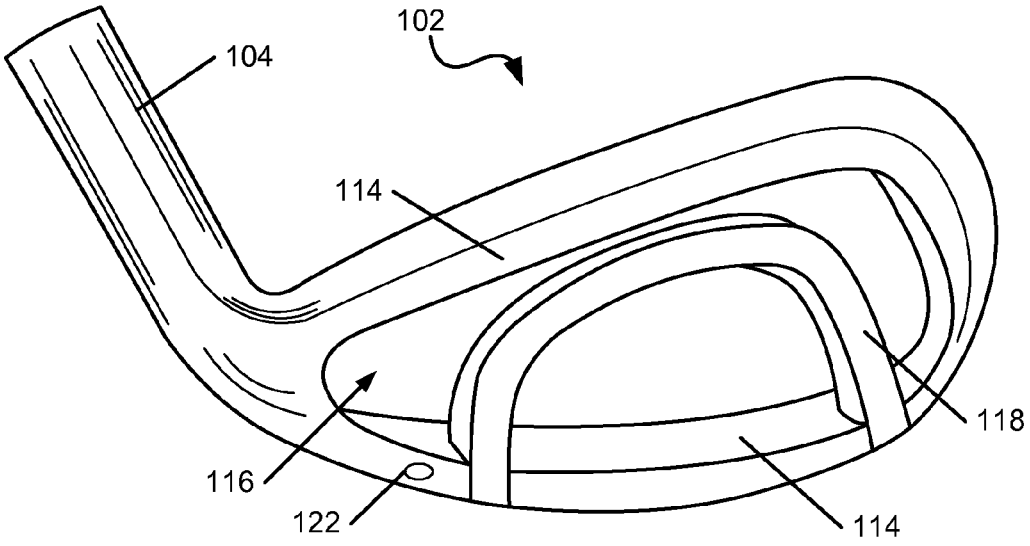
Figure 1C:
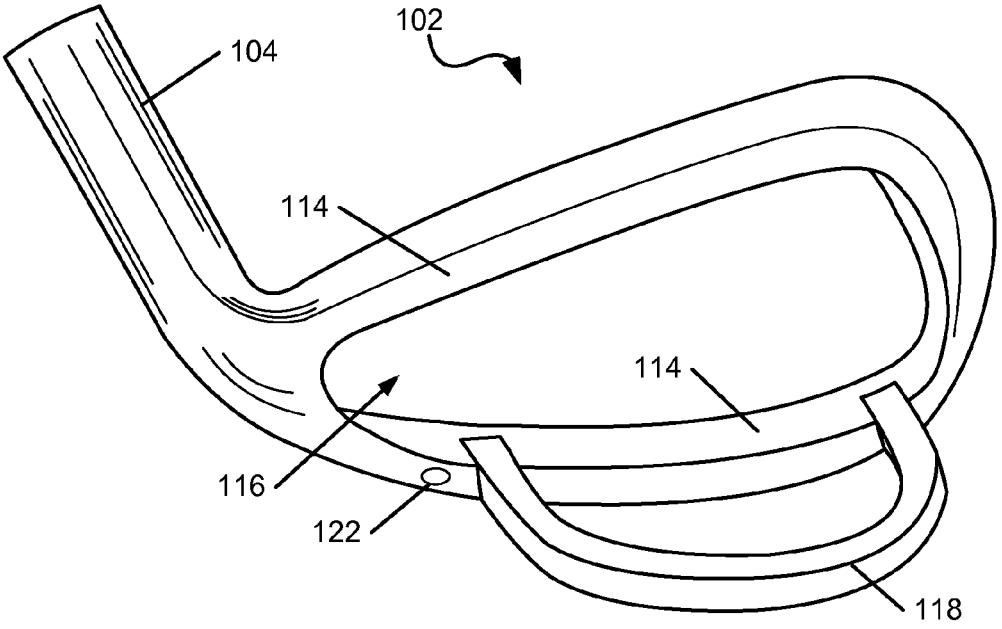

FIGS. 1B and 1C illustrate rear views of the example club head 102 of FIG. 1A. While the rear of the club head 102 may take on any desired form or shape without departing from the invention (e.g., a "blade" type iron, a hybrid type club iron, etc.), in this illustrated example, the club head 102 is formed as a perimeter weighted, cavity back club (note, for example, the perimeter weighting member(s) 114 and the rear cavity 116 defined behind the ball striking face 110). FIGS. 1B and 1C further illustrate a weight member 118 engaged at the rear of the club head 102. The weight member 118 may take on any desired form without departing from the invention. In this illustrated example, the weight member 118 constitutes a bridge member that extends along a portion of the rear cavity 116 of the club head 102 from the toe-to-heel direction. If desired, the weight member 118 may extend at least partially into the area defined by the rear cavity 116, although there is no requirement that it do so.

Figure 1D:
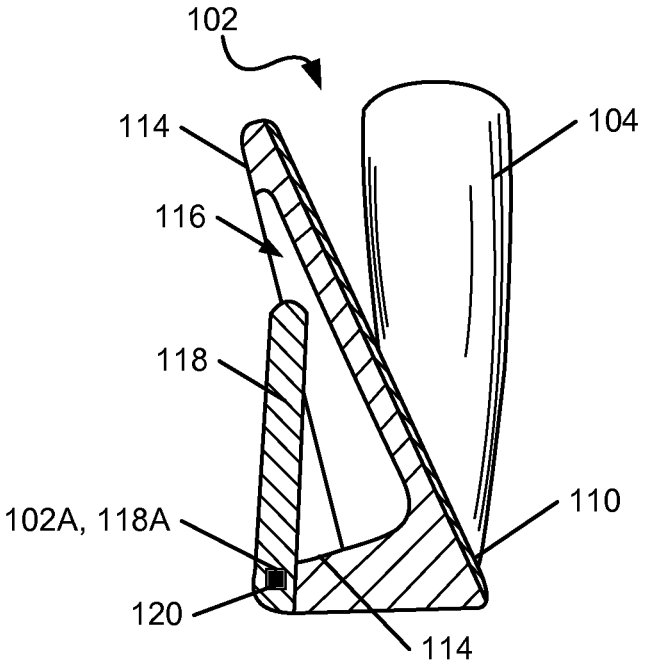
Figure 1E:
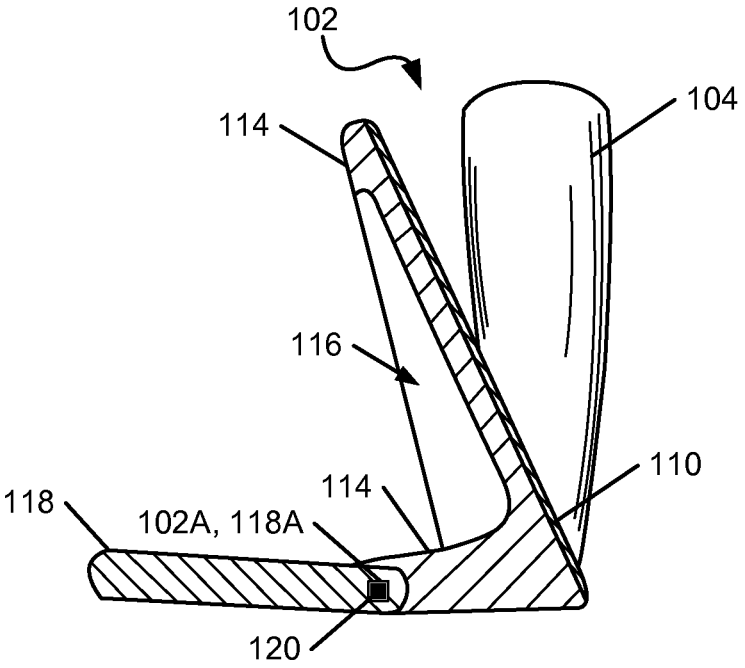

As evident from a comparison of FIGS. 1B and 1D with FIGS. 1C and 1E, the weight member 118 in accordance with this example of the invention is movable between an upright position (as shown in FIGS. 1B and 1D) and an extended position (as shown in FIGS. 1C and 1E). In its upright position, in this example structure 102, the weight member 118 extends from the club head body 102 (e.g., the lower perimeter weighting member 114) in a direction at least partially toward a front of the club head body 102 (e.g., toward the ball striking face 110). By moving the weight member 118 to its extended position (e.g., extending in a direction at least partially away from the front of the club head 102), as shown in FIGS. 1C and 1E, the overall center of gravity of the club head 102 is moved downward and rearward in the club head structure 102 (as compared to the center of gravity location with the weight member 118 at the upright position). Downward and rearward positioning of the club head's center of gravity tends to make the club 100 somewhat easier for golfers to use to get a ball airborne, with a higher loft, as compared to club heads with a higher and/or more forward center of gravity position (e.g., like that shown in FIGS. 1B and 1D). Also, placing the weight member 118 in the extended position shown in FIGS. 1C and 1E tends to increase the club head's moment of inertia (an indicator of the club head's resistance to twisting about at least one axis), which also can help golfers better launch a golf ball straighter and in the intended direction and avoid mis-hits. Therefore, orienting the weight member 118 in the extended position can be very useful, e.g., as a teaching aid, for youngsters or beginners, for high handicappers, etc.

The club head 102 and weight member 118 may be made of any desired materials without departing from this invention, including conventional materials known and used in the golf club construction art. As some specific examples, the club head body member 102 may be constructed from a lightweight material, such as lightweight stainless steel, titanium, nickel, magnesium, alloys, composites, polymers, and/or combinations thereof, and the weight member 118 may be constructed from and/or include a somewhat heavier material, such as lead, tungsten, or a lead-containing or tungsten-containing material (e.g., polymers or composites formed to include lead or tungsten, etc.). Of course, a wide variety of other materials and/or combinations of materials also may be used in the club head 102 construction without departing from this invention.

Any way of movably and/or removably mounting the weight member 118 with respect to the remainder of the club head 102 may be provided without departing from this invention. For example, a hinge or axle member about which the bridge member 118 is rotatably mounted may be provided. As another example, as illustrated in FIGS. 1D and 1E, if desired, a pin element 120 may be provided as a locking mechanism, removably extending through at least portions of the perimeter weighting structure 114 and the bridge member 118, to hold the bridge member 118 in place with respect to the club head 102. This pin member 120 may be readily removed by the user, if desired, via opening 122 for moving or changing positions and/or orientations of the bridge member 118 with respect to the remainder of the club head 102.

Also, any desired way of holding the bridge member 118 in place with respect to the club head body 102 may be used without departing from this invention. For example, if desired, the pin element 120 may be shaped (e.g., square, triangular, or other angular structures in cross section), at least in part, such that it will not allow rotation of the weight member 118 with respect to the club head 102 once the pin element 120 extends through openings 118A and 102A defined in the weight member 118 and the club head body 102, respectively (as shown in FIGS. 1D and 1E). As still additional examples, if desired, clamps, clasps, retaining elements, groove structures, detents, spring-loaded bolt members, and/or other mechanical elements may be provided to removably, movably, and/or releasably hold the weight member 118 in place with respect to the club head body 102. As still another example, if desired, a set screw, nut and bolt, or other type of threaded arrangement (e.g., pressing against and/or fitting into a recess and/or opening defined in the weight member 118) may be provided (e.g., through opening 122) to releasably lock the weight member 118 in place with respect to the club head body 102.

Additionally or alternatively, if desired, the weight member 118 and/or its locking mechanism may be designed so as to allow the weight member 118 to be secured at a variety of different positions without departing from the invention (e.g., at multiple positions between the upright position shown in FIG. 1B and the extended position shown in FIG. 1C). This may be accomplished in many different ways, e.g., using the various mechanisms described above (e.g., using a multi-sided pin element 120, using a set screw arrangement, etc.).

Figure 2A:
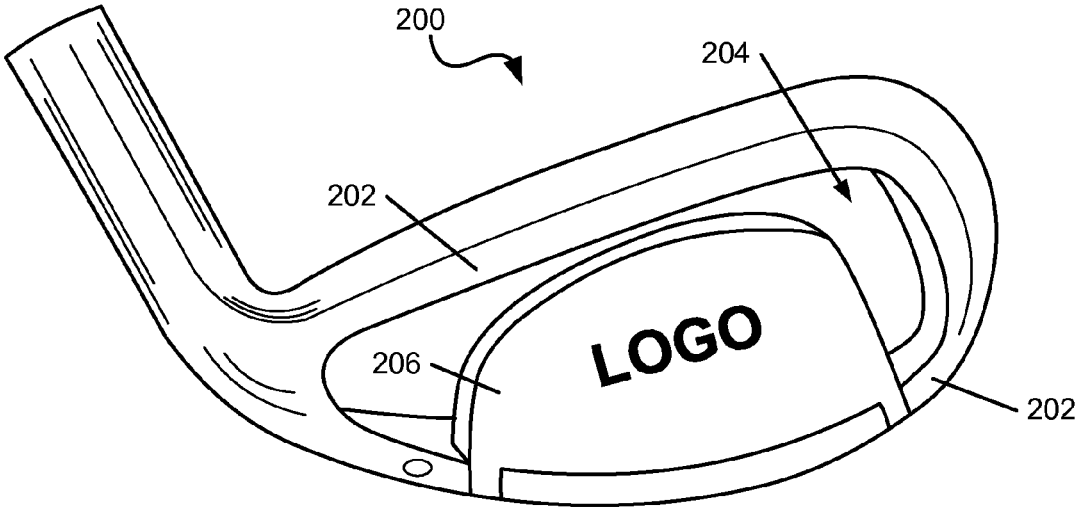
FIGS. 2A and 2B illustrate example features of additional example golf clubs and golf club heads in accordance with this invention (again, iron-type golf clubs and golf club heads are illustrated)
Figure 2B:
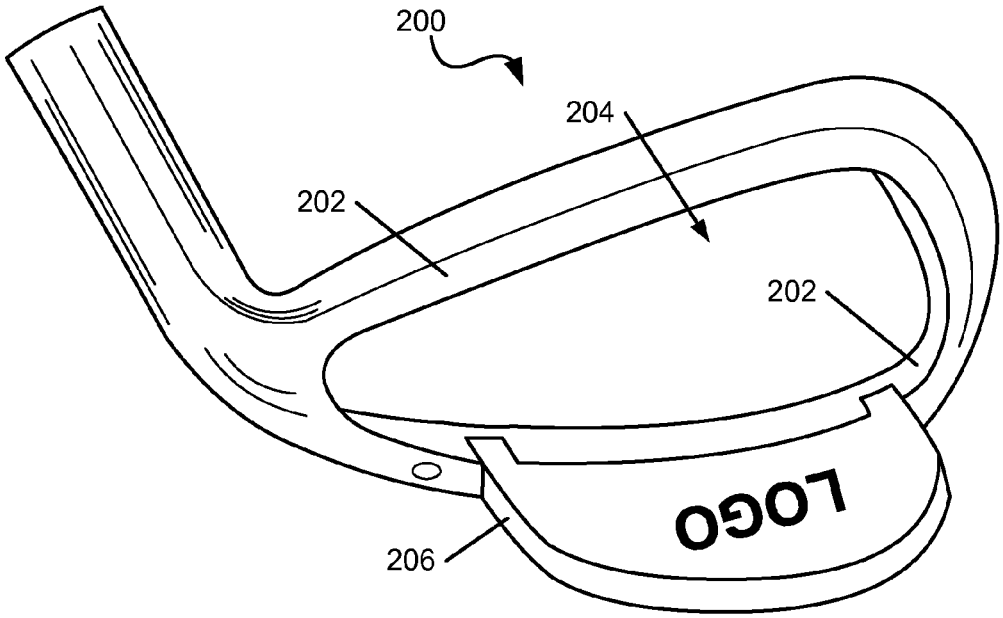

FIGS. 2A and 2B illustrate rear views of another example iron-type golf club head 200 that may be included in a golf club according to at least some examples of this invention. Again, in this example structure, the particularly illustrated club head 200 is formed as a perimeter weighted, cavity back club (note, for example, the perimeter weighting member(s) 202 and the rear cavity 204 defined in the back of the club head body 200), although any club head design may be used without departing from the invention (e.g., a "blade" type iron, a hybrid type club iron, etc.). In this illustrated example, however, the weight member 206 engaged at the rear of the club head 200 takes on a different form. More specifically, in this illustrated example, the weight member 206 does not include any open area, as illustrated in the example of FIGS. 1B and 1C. If desired, the example weight member 206 of FIGS. 2A and 2B may be formed by closing the open area of weight member 118 of FIGS. 1B and 1C (e.g., by attaching additional material to weight member 118, providing a screen or other cover member over weight member 118, etc.). Also, if desired, weight member 206 may extend at least partially into the area defined by the rear cavity 204, although there is no requirement that it do so. The weight member 206 also may be formed so as to be unevenly weighted across its overall width (e.g., in the club head heel-to-toe direction) and/or length (e.g., in the front-to-rear direction), such that the weight of member 206 can be positioned so as to favorably impact the center of gravity and/or moment of inertia characteristics of the club head 200 (e.g., toward the rear and/or outward areas of the club head 200), e.g., to customize these properties for a specific golfer and/or swing type.

As evident from a comparison of FIGS. 2A and 2B, weight member 206 in accordance with this example of the invention is movable between an upright position (as shown in FIG. 2A) and an extended position (as shown in FIG. 2B). This example weight member 206 may be oriented, positionable, movable, and lockable in place in any desired manner without departing from the invention, including the various manners described above in conjunction with the example of FIGS. 1A through 1E. The club head 200 according to this example structure also may have the favorable center of gravity and/or moment of inertia adjustability properties described above in conjunction with FIGS. 1A through 1E. This club head 200 and its associated weight member 206 also may be made from any desired materials, including the various specific materials described above for use in conjunction with the club head structure 102 of FIGS. 1A through 1E. Of course, if desired, the weight member 206 and/or its locking mechanism may be designed so as to allow the weight member 206 to be secured at a variety of different positions with respect to the club head body 200 without departing from the invention (e.g., at multiple different positions between the upright position shown in FIG. 2A and the fully extended position shown in FIG. 2B). Additionally, if desired, the weight member 206 may be constructed from multiple independent pieces and/or have any desired number of connections to the remainder of the club head body 200.

FIGS. 3A through 3D illustrate still additional example features of a golf club head 300 that may include a movable/removable weighting system in accordance with at least some examples of this invention. FIGS. 3A through 3D illustrate a perimeter weighted, cavity back iron-type club head 300 similar to the general structures described above in conjunction with FIGS. 1A through 2B (note the perimeter weighting member 302 and the recess or cavity 304), although any style of club head body may be provided without departing from the invention. In this example structure 300, the lower perimeter portion 302 of the club head 300 includes two raised boss members 306. These raised boss members 306 may be formed in any desired manner, in any desired sizes, and/or in any desired shapes without departing from the invention. Moreover, if desired, the boss members 306 need not be constructed of the same sizes or shapes and/or in the same manner. In at least some examples, the boss members 306 may be integrally formed as part of the overall club head structure 300, e.g., by conventional techniques known and used in the club making art, such as molding, casting, forging, or the like, or they may be separate elements engaged with the remainder of the club head structure 300, e.g., by threads, by mechanical connectors, by cements, etc.

Figure 3A:
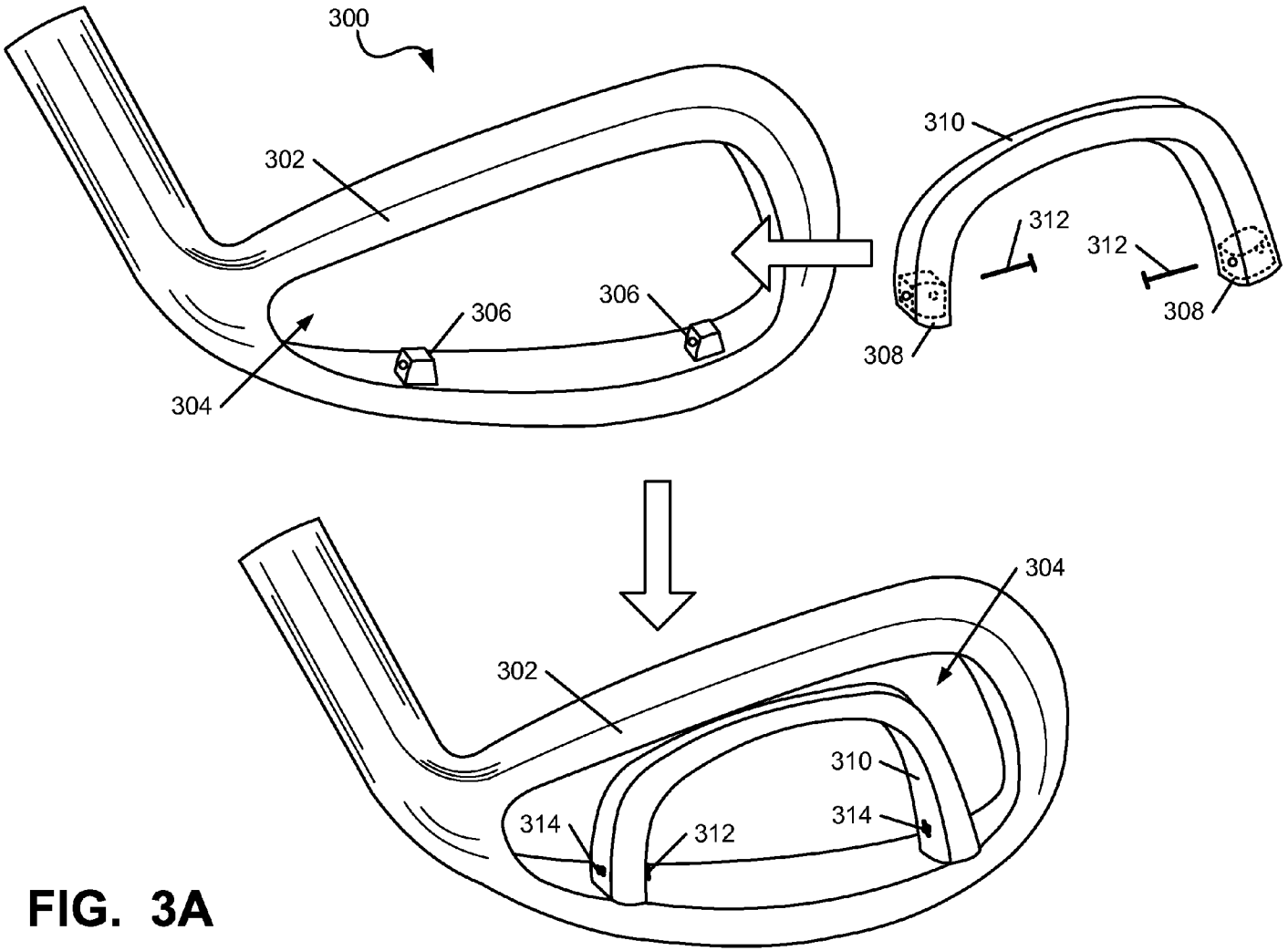
FIGS. 3A through 3D illustrate example features of additional example golf clubs and golf club heads in accordance with this invention (again, iron-type golf clubs and golf club heads are illustrated)
Figure 3D:
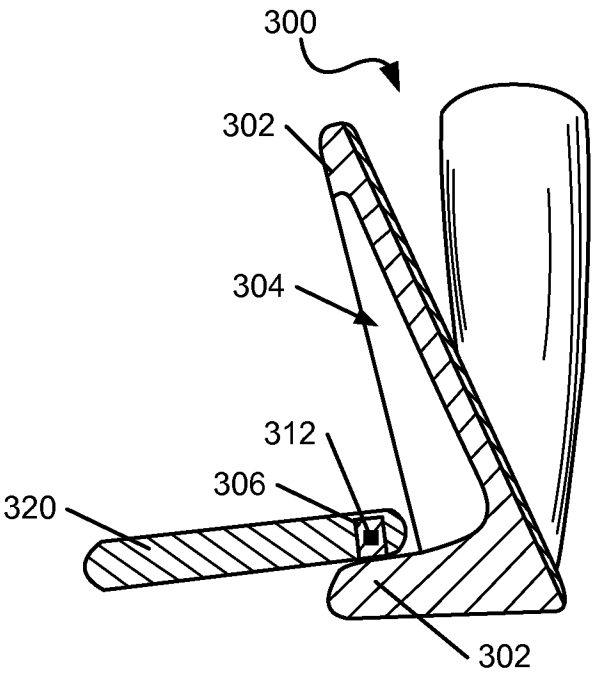
Figure 3B:
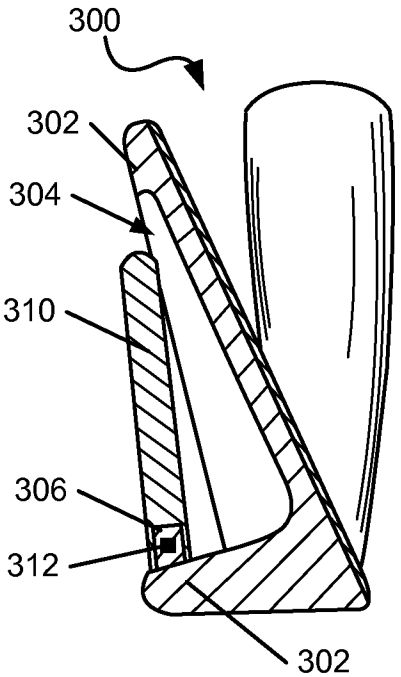

Boss members 306 may be designed to fit into openings 308 provided in a weight member 310 (e.g., in the ends of a bridge member, as shown in FIGS. 3A and 3B). Of course, the weight member 310 may take on a wide variety of different sizes, shapes, weights, weight distributions, and the like without departing from this invention. Optionally, if desired, plural weight members 310 may be attached to the various boss member(s) 306 without departing from this invention (e.g., one independent weight member attached to each independent boss member 306, etc.).

The weight member(s) 310 may be fixed in place with respect to the club head 300 and the boss member(s) 306 in any desired manner without departing from the invention. In this illustrated example, pin elements 312 are provided that extend through openings provided in the weight member 310 and the boss members 306. If desired, the pin elements 312 may be secured in place, e.g., once placed through the weight member 310 and the boss members 306, e.g., by a cotter pin 314, detents, spring-loaded retaining elements, threaded arrangements, or other securing mechanisms). As still another example, if desired, set screws may be provided, optionally that extend into openings or recesses defined in the boss members 306, to hold the bridge member 310 in place on the boss member(s) 306. Of course, other ways for holding the bridge member 310 in place with respect to the club head body 300 and the boss member(s) 306 may be used without departing from the invention, such as other threaded arrangements, mechanical connectors, clamps, clasps, and the like.

Alternatively, if desired, the club head body 300 may include the openings (e.g., in the surface of the perimeter weighting member 302), and the end(s) of one or more weight member(s) 310 may fit into (and be secured in) these openings (e.g., by structural retaining walls or elements; by detent mechanisms; by pins, set screws, threaded arrangements, clamps, clasps, or other mechanical connectors; etc.).

Figure 3C:
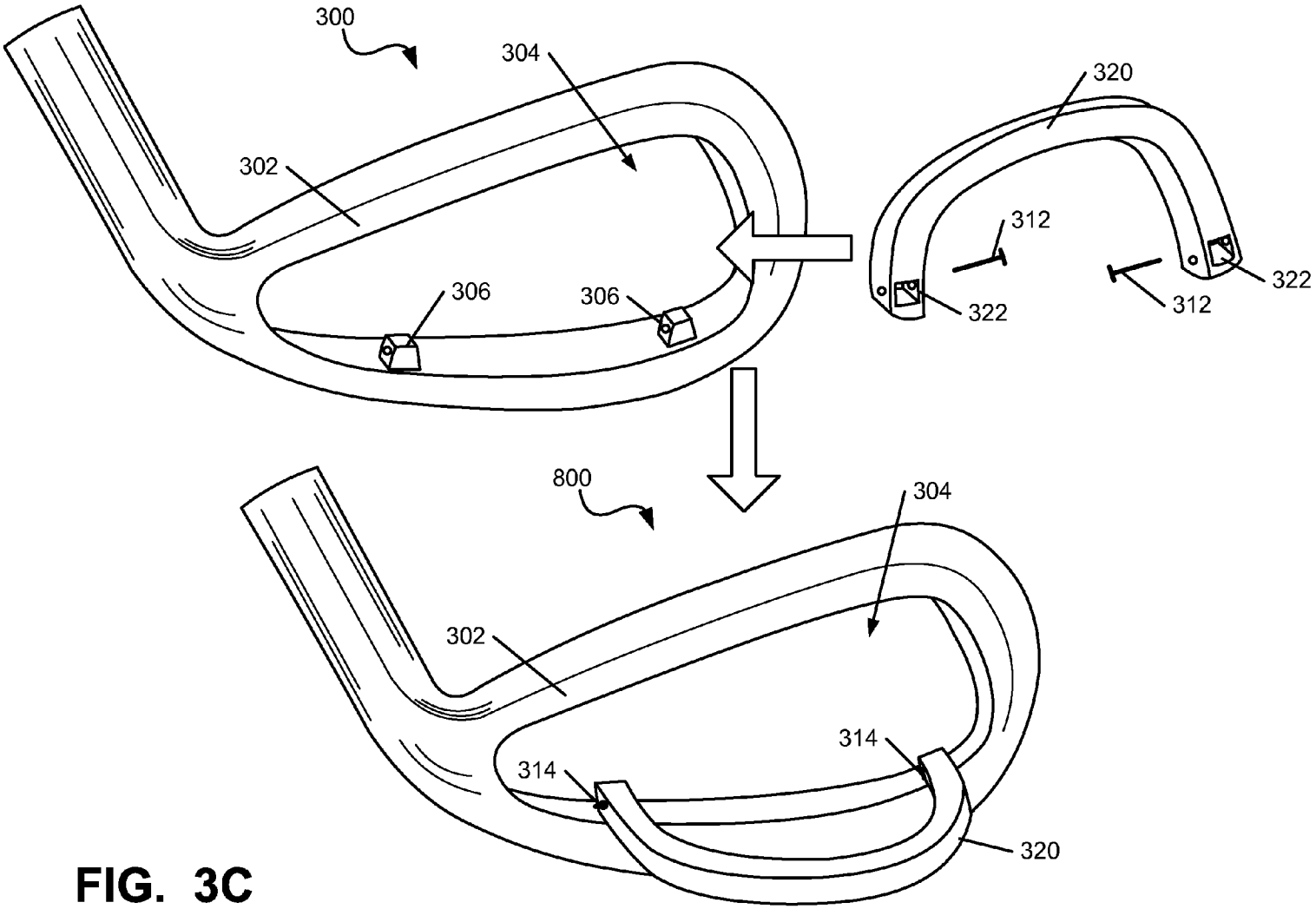

The bridge member 310 of FIGS. 3A and 3B can be readily attached to and removed from the remainder of the club head structure 300, e.g., by engaging and disengaging the pins 312 (or other securing mechanism) from the boss member(s) 306. This club head structure 300 retains the ability to provide an increased moment of inertia and/or to change the weighting and center of gravity characteristics by changing the overall shape of the club head structure 300. More specifically, in this example club head structure 300 according to the invention, rather than move the weight member 310 between the upright and extended positions in the manner described above in conjunction with FIGS. 1A through 2B, the shape, center of gravity, weighting, and/or moment of inertia characteristics of the club head structure 300 are changed by exchanging one weight member for another. FIGS. 3A and 3B illustrate the club head structure 300 with a weight member 310 attached, and this weight member 310 is arranged in the upright position. To change this club head 300 (as shown in FIGS. 3A and 3B) to a structure having a weight member in an extended position, weight member 310 is removed from the boss member(s) 306 (e.g., by removing the cotter pins 314, removing pins 312, and/or otherwise disengaging a locking or securing mechanism (if any and if necessary)). Then, as shown in FIGS. 3C and 3D, a different weight member 320 may be secured to the club head body 300. Weight member 320 of this example structure 300 includes openings 322 defined in lower side surfaces thereof for receiving the boss members 306. In this manner, the weight member 320 may be provided so as to extend from the perimeter weighted structure 302 in a direction away from the front of the club head body 300. If desired, the same securing mechanism(s) may be used to secure weight member 320 in place as used to secure weight member 310 in place (e.g., pin 312 and cotter pin 314, set screws, or the various other securing mechanisms described above), although different securing elements and/or mechanisms may be used without departing from the invention.

As another option, if desired, it is not necessary to provide two separate weight members 310 and 320 to produce the two weight member positions of FIGS. 3A through 3D. Rather, if desired, the openings (e.g., openings 308 and 322) for the two orientations may be provided on a single weight member structure. As still another potential alternative, if desired, a plurality of weighting members having a variety of different weighting characteristics and/or mounting orientations may be provided (e.g., as a kit) without departing from the invention (e.g., to give the user and/or club fitter numerous shape, center of gravity, weighting, and/or moment of inertia customization options, to allow selective heel or toe weighting, to allow fade or draw biasing, to allow hook or slice correction, etc.).

While FIGS. 1A through 3D generally illustrate iron-type club head structures, those skilled in the art will appreciate, of course, that these example structures and aspects of the invention may be included and practiced on any type of club head (e.g., woods, putters, etc.), including any type of iron-type club head, such as driving irons, 0-irons through 10-irons, any types of wedges (e.g., pitching wedges, sand wedges, gap wedges, lob wedges, etc.), iron-type hybrid clubs, and the like.

B. Example Wood-Type Golf Club Structures

As noted above, aspects of this invention are not limited to use with irons and/or hybrid iron-type golf clubs and golf club heads. FIGS. 4A through 4D illustrate example configurations of a wood-type golf club 400 in accordance with at least some examples of this invention, in which the overall exterior shape or appearance of the club head 402 may be changed to affect the moment of inertia, weighting, and/or center of gravity characteristics of the club head 402.

Figure 4A:
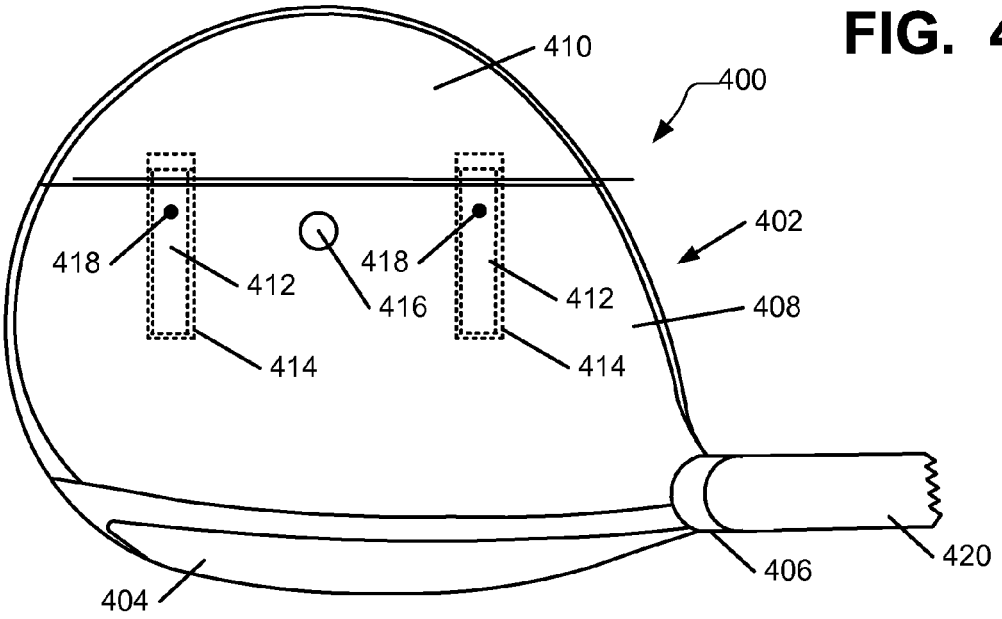
FIGS. 4A through 4D illustrate example features of additional example golf clubs and golf club heads in accordance with this invention (wood-type golf clubs and golf club heads are illustrated)

As shown in FIG. 4A and mentioned above, the club 400 includes a club head 402. Any desired construction of the body member 402 is possible without departing from the invention. In this illustrated example, the club head 402 includes a ball striking face 404, a hosel area 406, and a main body member 408 extending back from and immediately behind the ball striking face 404. A shaft 420 is attached to the club head 402 at the hosel area 406, and this shaft 420 further may include a grip element (not shown) formed therein or attached thereto. The various parts of the club head structure 402 mentioned above may be made from any desired number of different individual parts or pieces, including from one integral piece, if desired. Alternatively, if desired, the club head 402 may be made from multiple independent parts joined together (such as from one or more of a ball striking face, a crown member, at least one body or ribbon member, a sole member, a sole plate, etc.) in any desired manner, including in conventional manners known and used in the art (e.g., using welding or other fusing techniques, adhesives or cements, mechanical connectors, etc.). Additionally, the club head 402 may be made from one or more different types of materials, including conventional materials known and used in the art, such as metals, metal alloys (e.g., steel, titanium alloys, nickel alloys, magnesium alloys, etc.), composites (e.g., carbon fiber composites, etc.), wood, polymers, and/or combinations thereof. The club head 402 may be hollow, at least partially hollow, mostly solid, or solid, and/or may be formed in any desired construction or manner, including in conventional constructions and manners known and used in the golf club art.

Figure 4B:
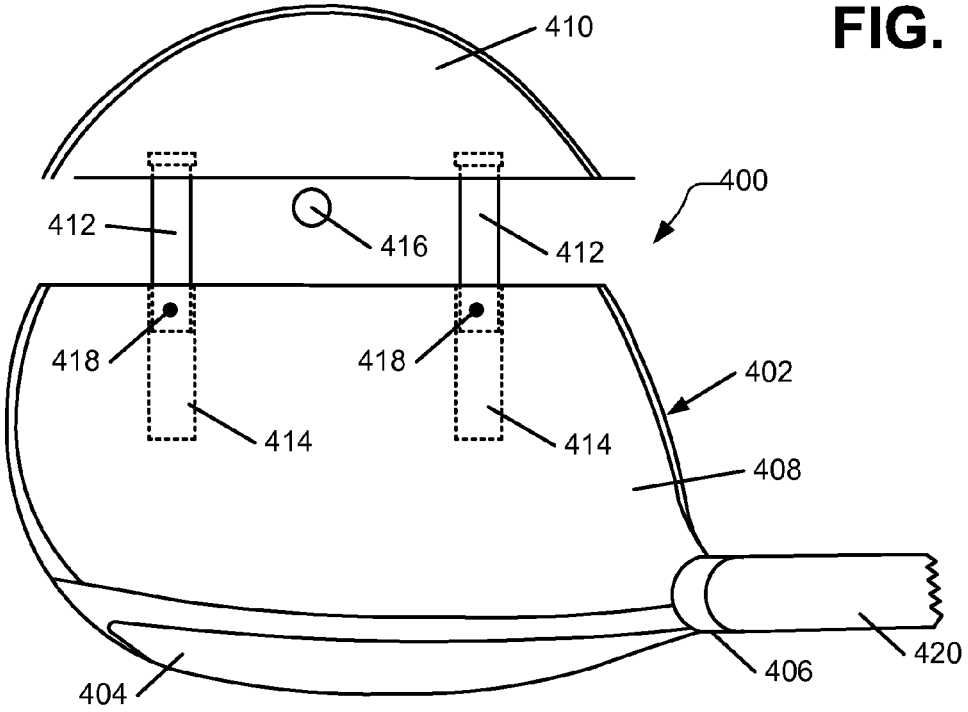

In this illustrated example, the club head 402 includes a rear located auxiliary body member 410 that may be movable with respect to the main body member 408 and/or the remainder of the club head structure 402 from an adjacent position (as shown in FIG. 4A) to an extended position (as shown in FIG. 4B). The auxiliary body member 410 may be constructed of materials the same as or similar to those used in main body member 408, and it may be constructed and finished so as to have a continuous, matching engagement with the main body member 408 (to appear essentially like a conventional club head) when at the adjacent position. These features, however, are not a requirement. Any desired manner of movably mounting the auxiliary body member 410 with respect to the main body member 408 may be used without departing from this invention. For example, in this illustrated structure 400, the auxiliary body member 410 includes extending rails or projections 412 that extend into grooves, chambers, or recesses 414 defined in the interior or on the exterior (e.g., along the sole) of the main body member 408. Then, as can be seen by a comparison of FIG. 4A with FIG. 4B, the auxiliary body member 410 can be moved from the adjacent position to the extended position by sliding the auxiliary body member 410 rearward with respect to the main body member 408. By moving the auxiliary body member 410 rearward, as shown in FIG. 4B, the center of gravity 416 of the overall club head structure 402 also may be moved rearward (as compared to its location in the adjacent arrangement shown in FIG. 4A) and the moment of inertia may be increased. These features generally make it easier for users to get a golf ball airborne and make it easier to direct the ball straight, in the desired direction, without undesired spin. Thus, the club 400 with the auxiliary body member 410 in the extended position (as shown in FIG. 4B) may be particularly useful as a training aid or as a club for beginners or high handicappers. If desired, the auxiliary body member 410 may be constructed to include additional weight (e.g., attached thereto, integrated therein, based on its construction or materials, etc.), optionally at targeted locations, to enable greater influence on the center of gravity, weighting, and/or moment of inertia characteristics of the club head 402.

Alternatively, if desired, the auxiliary body member 410 may be made from multiple different pieces, optionally each with its own associated attaching mechanism (e.g., rails or openings for receiving rails), optionally in any desired arrangement (e.g., arranged adjacent horizontally and/or vertically), without departing from this invention.

The auxiliary body member(s) 410 may be secured to or fixed in place with respect to the club head 402 and/or the main body member 408 in any desired manner without departing from the invention. In this illustrated example, pin elements 418 are provided that extend through openings provided in or recesses formed in the main body member 408 and the rail 412. If desired, the pin elements 418 may be secured in place once placed through the main body member 408 and the rail 412, e.g., by a cotter pin, detents, spring-loaded retaining elements, or other securing mechanisms. As still another example, if desired, set screws and openings for receiving them may be provided, and optionally the set screws may extend into openings or recesses defined in the rail members 412, to hold the auxiliary body member(s) 410 in place with respect to the main body member 408. Of course, other ways for holding the auxiliary body member(s) 410 in place with respect to the remainder of the club head 402 and the main body member 408 may be used without departing from the invention, such as other threaded arrangements, mechanical connectors, clamps, clasps, and the like. Also, if desired, the set screw or other securing arrangement may be provided so as to engage any desired location along the rail member(s) 412, to thereby enable wide variance in the possible extension distance between the auxiliary body member(s) 410 and the main body member(s) 408.

Additionally, if desired, an additional body component or components (not shown) may be provided in the open space between the body portions 408 and 410 in the extended arrangement shown in FIG. 4B, to thereby close the overall structure 402 and eliminate the open space. This additional body component may be a ring or band of material shaped and/or finished to provide a tight fit and an overall aesthetically pleasing appearance in combination with the remainder of the club head structure 402. If desired, these additional components may be arranged to slide or otherwise move into and out of the body portions 408 and/or 410 when the body portions 408 and 410 are moved relative to one another.

This example club head structure 402 is not limited to club heads where the auxiliary body member 410 only slides frontward and/or rearward with respect to the main body member 408. Instead, the auxiliary body member(s) 410, as well as projections 412 and chambers 414, may be arranged to enable the auxiliary body member(s) 410 to move in any desired direction (e.g., rearward and toward the toe, rearward and toward the heel, etc.).

Figure 4C:
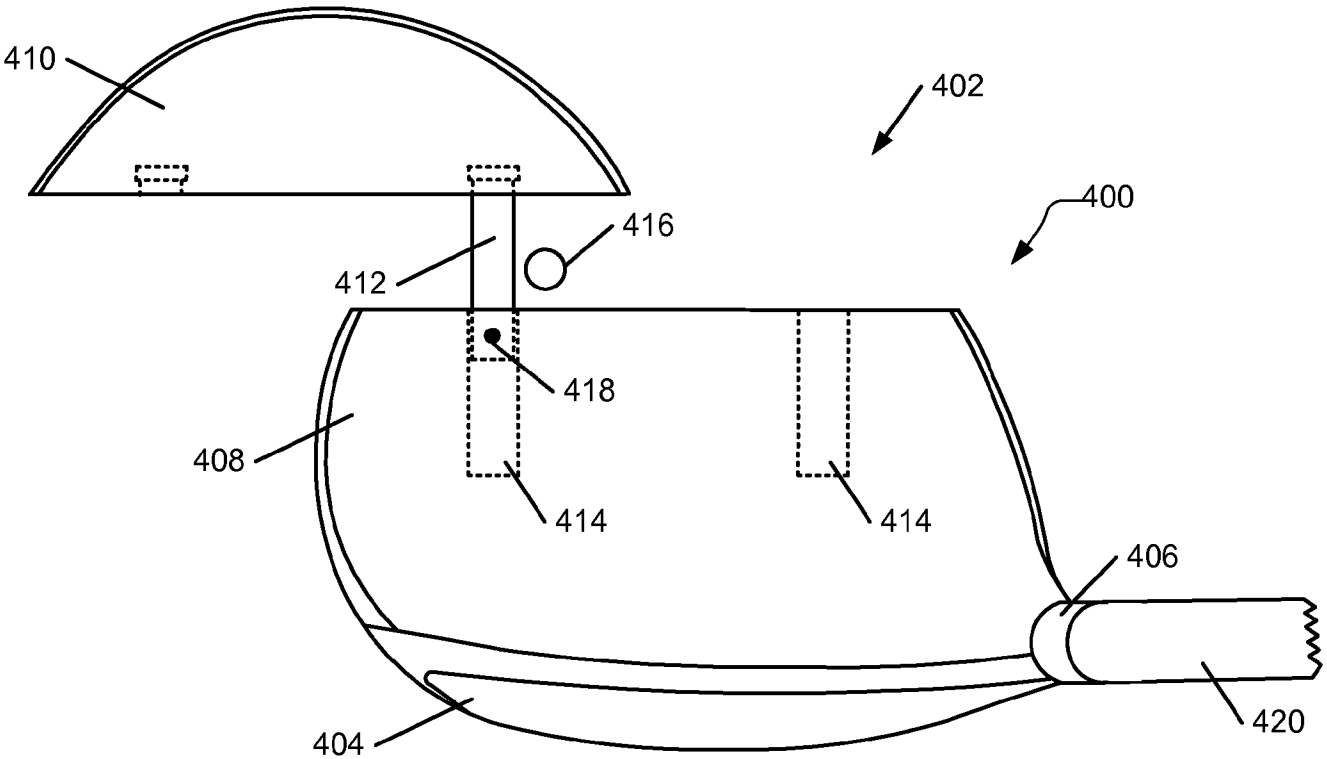
Figure 4D:
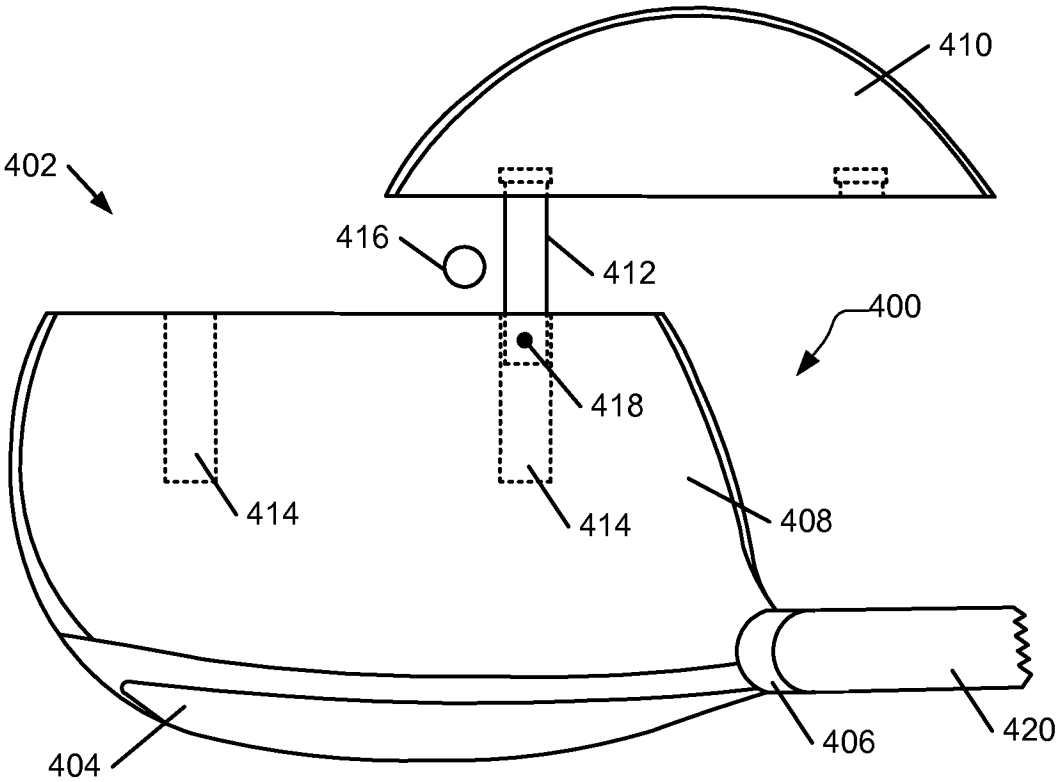

Additionally, the auxiliary body member(s) 410 motion or adjustability is not limited to reciprocal back-and-forth motion as shown in FIGS. 4A and 4B. Rather, as illustrated in FIGS. 4C and 4D, if desired, the auxiliary body member 410 may be rearranged with respect to the main body member 408 to have additional impact on the club head's characteristics. For example, by loosening or removing the locking mechanism 418, the auxiliary body member 410 may be completely removed from the main body member 408. Then, as shown in FIG. 4C, the right (or heel oriented) rail 412 may be slid into and secured in the left (or toe oriented) opening 414 in the main body member 408 to thereby shift the auxiliary body member 410 further toward the toe area of the club head structure 402 (and thereby shifting the center of gravity 416 and further affecting the moment of inertia and/or other club head characteristics). (The same general weighting and structural changes could be accomplished by rotating the auxiliary body member 410 around the toe oriented rail 412, once the auxiliary body member's connection to the heel oriented rail 412 is removed or loosened). If desired, in this example structure 402, the rail members 412 may be releasably mounted to the auxiliary body member(s) 410 (e.g., by threads, mechanical connectors, etc.), so that they can be removed therefrom as shown in FIG. 4C. Toe weighting the club head 402 in this manner can help correct ball flights for players that tend to excessively draw or hook the ball, by helping the toe portion of the club head 402 lag somewhat and not get in front of the heel portion.

Alternatively, as shown in FIG. 4D, if desired, the right (or toe oriented) rail 412 may be slid into and secured in the left (or heel oriented) opening 414 in the main body member 408 to thereby shift the auxiliary body member 410 further toward the heel area of the club head structure 402 (and thereby shifting the center of gravity 416 and further affecting the moment of inertia and/or other club head characteristics). Again, if desired, the rail members 412 may be releasably mounted to the auxiliary body member(s) 410 (e.g., by threads, mechanical connectors, etc.), so that they can be removed as shown in FIG. 4D. Heel weighting the club head 402 in this manner can help correct ball flights for players that tend to excessively fade or slice the ball, by helping the toe portion of the club head 402 move forward more quickly with respect to the heel portion of the club head 402. The same general weighting and structural changes as shown in FIG. 4D also may be accomplished by rotating the auxiliary body member 410 around the heel oriented rail 412, once the auxiliary body member's connection to the toe oriented rail 412 is removed or loosened.

Figure 5A:
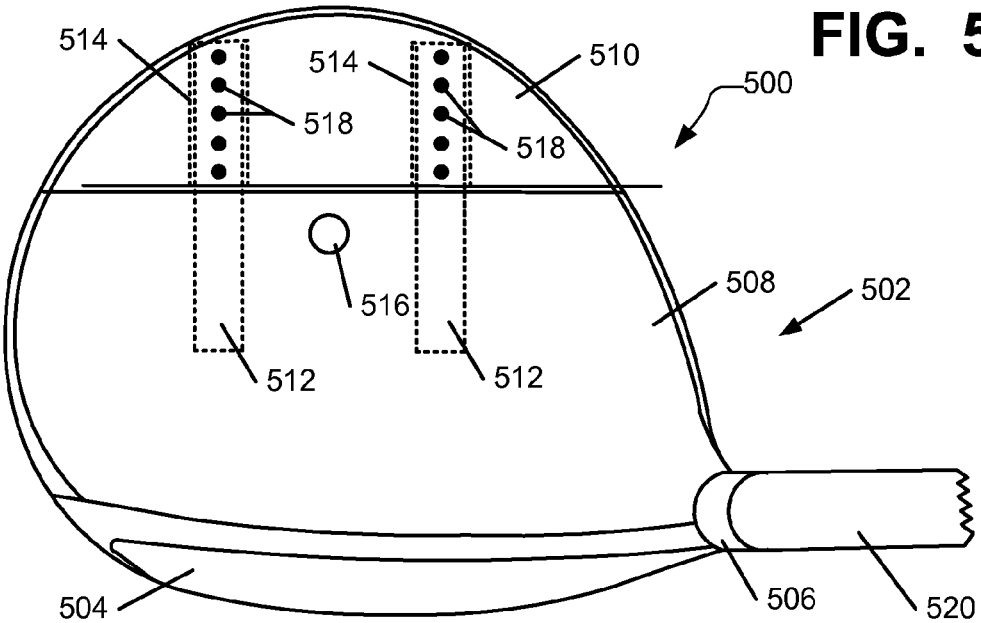
FIGS. 5A and 5B illustrate example features of additional example golf clubs and golf club heads in accordance with this invention (again, wood-type golf clubs and golf club heads are illustrated)
Figure 5B:
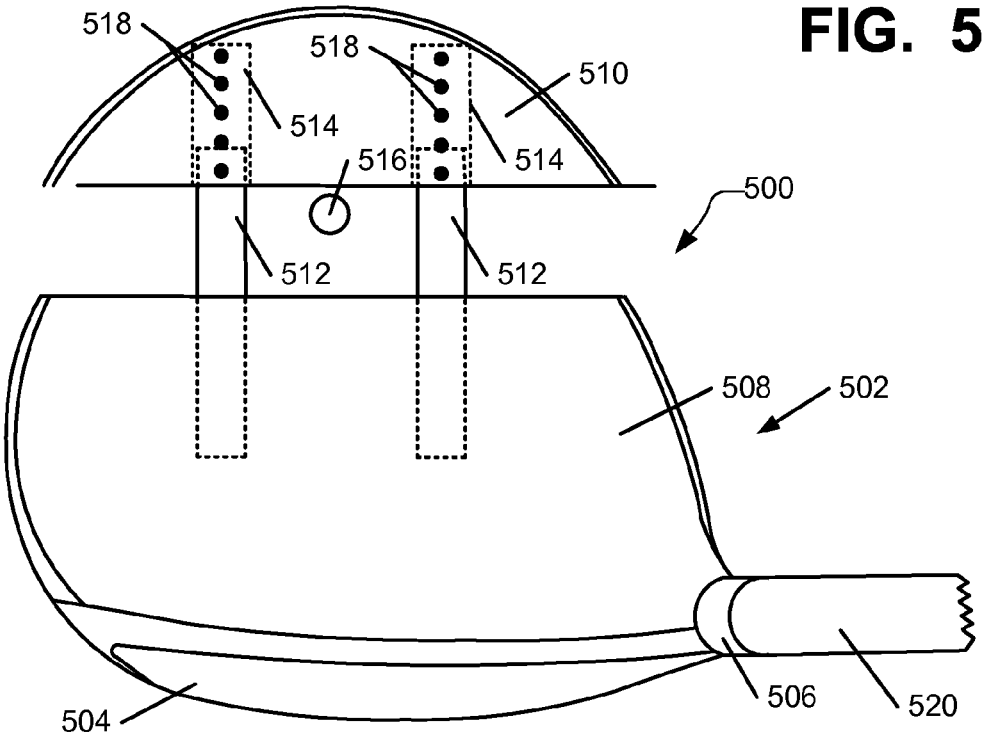

FIGS. 5A and 5B illustrate another example wood-type golf club 500 in which the overall exterior shape or appearance of the club head 502 may be changed to affect the moment of inertia, weighting, and/or center of gravity characteristics of the club head 502. Again, in this example, the club head 502 may have any desired construction without departing from the invention. In this illustrated example, the club head 502 includes a ball striking face 504, a hosel area 506, and a main body member 508 extending back from and immediately behind the ball striking face 504. A shaft 520 is attached to the club head 502 at the hosel area 506, and this shaft 520 further may include a grip element (not shown) formed therein or attached thereto. The various parts of the club head structure 502 may be constructed from the various independent pieces, materials, etc., in the same manner as the club head 402 described above in conjunction with FIGS. 4A through 4D. Additionally, the club head 502 may be hollow, at least partially hollow, mostly solid, completely solid, and/or formed in any desired construction or manner, including in conventional constructions and manners known and used in the golf club art.

In this illustrated example, like the example of FIGS. 4A through 4D, the club head 502 includes a rear located auxiliary body member 510 that may be movable with respect to the main body member 508 and/or the remainder of the club head structure 502 from an adjacent position (as shown in FIG. 5A) to an extended position (as shown in FIG. 5B). At the adjacent position, the auxiliary body member 510 may fit against and/or within the main body member 508 in such a manner as to have a contiguous appearance, akin to a conventional wood-type golf club. If desired, at the extended position of FIG. 5B, an additional body component (not shown) may be added to the structure to close the open area. In this example structure 502, in contrast to the example of FIGS. 4A through 4D, the main body member 508 includes extending rails or projections 512 that extend into grooves, chambers, or recesses 514 defined in the interior or along the exterior surface of the auxiliary body member 510. Then, as can be seen by a comparison of FIG. 5A with FIG. 5B, the auxiliary body member 510 can be moved from the adjacent position to the extended position by sliding the auxiliary body member 510 rearward with respect to the main body member 508. By moving the auxiliary body member 510 rearward, as shown in FIG. 5B, the center of gravity 516 of the overall club head structure 502 also may be moved rearward (as compared to its location in the adjacent arrangement shown in FIG. 5A) and the moment of inertia may be increased, to thereby make it easier for golfers to use this club to get a golf ball airborne, flying straight, in the desired direction, without undesired spin. In its extended form, the club 500 may be particularly useful as a training aid and/or for beginners or high handicappers. If desired, the auxiliary body member 510 may be constructed to include additional weight (e.g., attached thereto, integrated therein, based on its construction or materials, etc.) to enable greater influence on the center of gravity, weighting, and/or moment of inertia characteristics of the club head 502.

Alternatively, if desired, either or both of the body members 508 and 510 may include rails 512 and grooves, chambers, or recesses 514 that match up with complementary grooves, chambers, or recesses 514 and rails 512, respectively, provided on the opposite structure. As still another alternative, if desired, the auxiliary body member 510 may be made from multiple different pieces, optionally each with its own associated attaching mechanism (e.g., rails and/or grooves, chambers, or recesses for receiving rails), optionally in any desired arrangement (e.g., arranged adjacent horizontally and/or vertically), without departing from this invention.

The auxiliary body member(s) 510 may be fixed in place with respect to the club head 502 and/or the main body member 508 in any desired manner without departing from the invention. In this illustrated example, one or more pin members or set screws are provided to extend through one or more openings 518 defined in the auxiliary body member 510 and to engage the rail 512 of the main body member 508 (the rail 512 may include recesses or openings to receive the set screw or pin members). Any other desired type of securing mechanism may be used without departing from the invention, such as pins, detent mechanisms, spring-loaded retaining elements, bolts or other threaded arrangements, mechanical connectors, clamps, clasps, and the like. Also, if desired, openings 518 and/or pin members (or other securing arrangements) may be provided at various locations along the auxiliary body member 510 so as to allow the rail member 512 to be secured with respect to the auxiliary body member 510 at various different locations along the rail member(s) 512, to thereby enable wide variance of the extension distance between the auxiliary body member(s) 510 and the main body member(s) 508.

Also, if desired, the rail member(s) 512 may be designed to be removable from the main club head body 508 member and/or the auxiliary club head body member 510 so that toe and heel weighting can be accomplished with this club head structure 502, in a manner as shown in and/or similar to that described above in conjunction with FIGS. 4C and 4D. Additionally or alternatively, if desired, one body member 510 may be removed and exchanged with a different body member 510, e.g., having different shape, weighting, center of gravity, moment of inertia, or other characteristics.

Figure 6A:
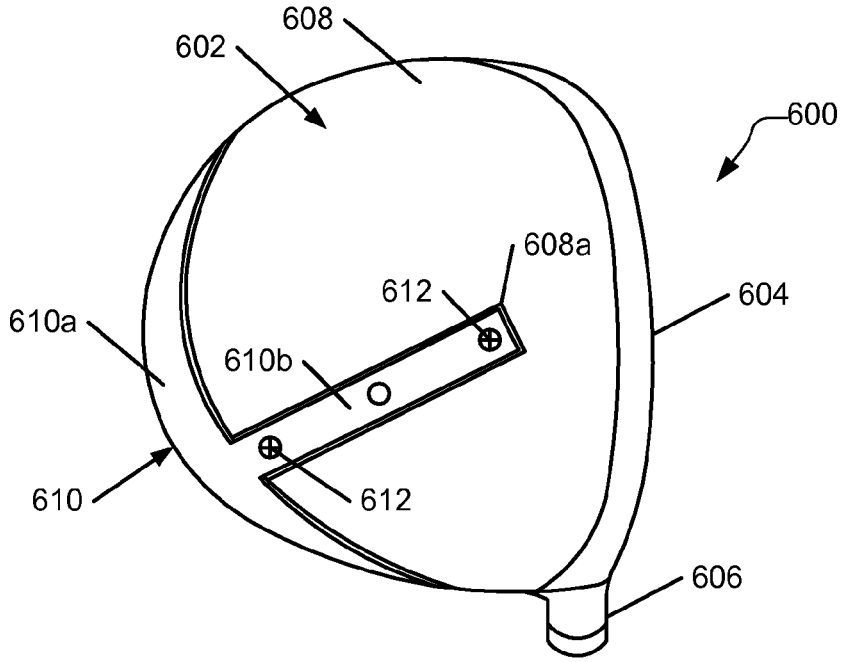
FIGS. 6A and 6B illustrate example features of additional example golf clubs and golf club heads in accordance with this invention (again, wood-type golf clubs and golf club heads are illustrated)
Figure 6B:
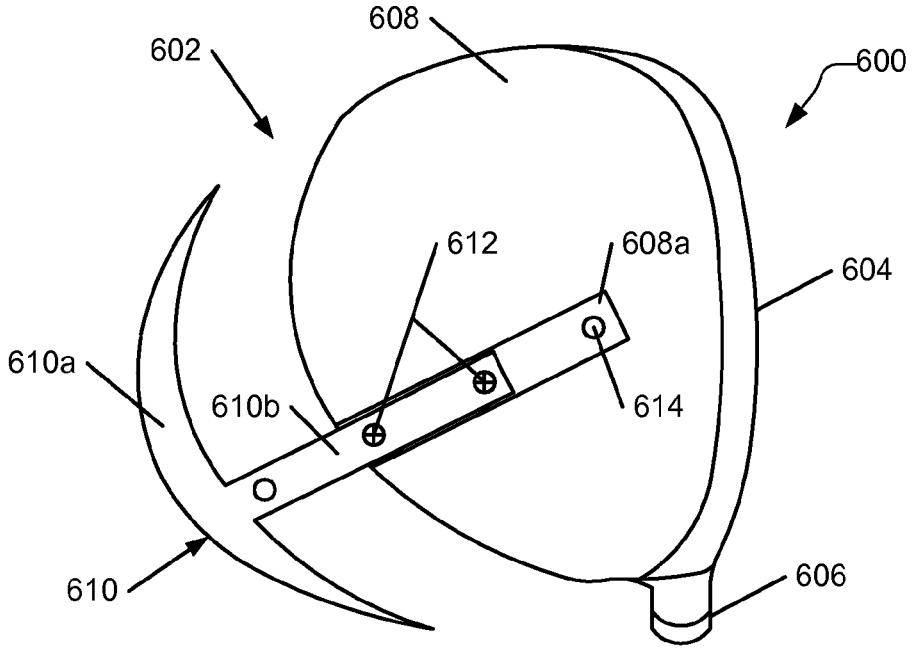

FIGS. 6A and 6B illustrate another example wood-type golf club 600 in which the overall exterior shape or appearance of the club head 602 may be changed to affect the moment of inertia, weighting, and/or center of gravity characteristics of the club head 602. Again, in this example, the club head 602 may have any desired construction without departing from the invention. In this illustrated example, the club head 602 includes a ball striking face 604, a hosel area 606, and a main body member 608 extending back from and immediately behind the ball striking face 604. A shaft (not shown) may be attached to the club head 602 at the hosel area 606, and this shaft further may include a grip element (not shown) formed therein or attached thereto, e.g., in a manner similar to the other example structures described above. The various parts of the club head structure 602 may be constructed from the various independent pieces, materials, etc., e.g., in the same manners as the club heads 402 and 502 described above in conjunction with FIGS. 4A through 5B. Additionally, the main body member 608 may be hollow, at least partially hollow, mostly solid, completely solid, and/or formed in any desired construction or manner, including in conventional constructions and manners known and used in the golf club art.

In this illustrated example, the club head 602 includes a rear located auxiliary body member 610 that may be movable with respect to the main body member 608 and/or the remainder of the club head structure 602 from an adjacent position (as shown in FIG. 6A) to an extended position (as shown in FIG. 6B). At the adjacent position, the auxiliary body member 610 may fit against and/or within the main body member 608 in such a manner as to have a contiguous appearance, akin to a conventional wood-type golf club. In this example structure 600, in contrast to the examples described above, the auxiliary body member 610 fits around portions of the rear and heel sides of the club head 602 and may be moved to extend away from the main body member 608 at an angle, toward the rear and heel sides of the club head 602, to thereby move the center of gravity more toward the rear and heel sides of the club head 602.

The auxiliary body member 610 of this structure includes a "bow" portion 610*a* and an extending rail member 610*b* that is movable along a slot, opening, or groove 608*a* formed in the bottom or sole portion of the club head main body 608. Of course, if desired, the rail member 610*b* may extend into the interior of the club head main body 608 rather than along its exterior surface without departing from this invention. The auxiliary body member 610 may be secured with respect to the main body 608 in any desired manner without departing from this invention, including the various manners described above (e.g., via set screws, spring-loaded detent mechanisms, retaining structures, etc.). In this illustrated example structure 600, one or more screw members 612 are provided that extend through the rail member 610*b* and secure into threaded openings 614 provided in the main body 608. Also, if desired, the securing mechanism(s) may be provided so as to enable the auxiliary body member 610 to be mounted at a wide variety of locations with respect to the main body member 608 (e.g., so as to allow wide variance in the amount of extension).

Of course, any shape auxiliary member 610 may be provided, and it may be designed to extend away from the club head main body 608 on any desired number of rail members 610*b* in any desired direction(s) without departing from this invention. Also, if desired, an additional body component (not shown) may be provided to fill in the open space between the auxiliary body member 610 and the main body member 608, without departing from the invention. The auxiliary member 610 also may be provided at any desired location on and/or extend any desired proportion of the exterior club perimeter.

As mentioned above, and as can be seen by a comparison of FIG. 6A with FIG. 6B, the auxiliary body member 610 can be moved from the adjacent position to the extended position by sliding the auxiliary body member 610 rearward and heelward with respect to the main body member 608. By moving the auxiliary body member 610 rearward and heelward, as shown in FIG. 6B, the center of gravity of the overall club head structure 602 also may be moved rearward and heelward (as compared to its location in the adjacent arrangement shown in FIG. 6A). If desired, the auxiliary body member 610 may be constructed to include additional weight (e.g., attached thereto, integrated therein, based on its construction or materials, etc.) to enable greater influence on the center of gravity, weighting, and/or moment of inertia characteristics of the overall club head structure 602.

Alternatively, if desired, the auxiliary body member 610 may be made from multiple different pieces, optionally each with its own associated attaching mechanism (e.g., rails and/or grooves, chambers, or recesses for receiving rails), optionally in any desired arrangement (e.g., arranged adjacent in the horizontal, vertical, heel-to-toe, and/or front-to-rear directions) and extending in any desired direction, without departing from this invention.

Also, if desired, the auxiliary body member 610 may be designed to be removable from and/or re-orientable with respect to the main club head body 608 member (e.g., to enable the auxiliary body member 610 to be rotated along the extending rail 610*b*, flipped over, etc.). This allows still further options in varying the overall characteristics of the club head 602.

Wood-type golf clubs and golf club heads according to aspects of this invention are not limited to types in which an entire portion of the club head body structure moves to change the overall shape (and thus the center of gravity, weighting, and/or moment of inertia characteristics) of the club head, as shown in FIGS. 4A through 6B. FIGS. 7A and 7B illustrate an example golf club structure 700, including a club head 702, ball striking face 704, hosel area 706, and shaft member 708 in the general manner described above in conjunction with FIGS. 4A through 6B. These various parts of golf club 700 may be made in any desired construction, in any desired manner, and from any desired materials or numbers of individual parts or pieces, without departing from the invention, including in conventional constructions, in conventional manners, from conventional materials, and with conventional parts as are known and used in the golf club art.

In this example structure 700, however, the club head 702 includes one or more grooves, recesses, or chambers 710 defined therein. The chamber(s) 710 may be produced in the club head 702 in any desired manner, such as by attaching a housing defining at least some portions of the chamber(s) 710 to an interior of the club head body (e.g., welding it to, molding it with, cementing it to, or otherwise attaching it to the interior of the club head 702 sole or body member), machining it into the interior of the club head 702 (e.g., drilling into a solid portion of the club head 702 interior, etc.), or the like. The groove(s), recess(es), or chamber(s) 710 include opening(s) 712 defined therein to allow access from the exterior. One or more weight members 714 may be received in the groove(s), recess(es), or chamber(s) via the opening(s) 712, as shown in FIG. 7A. If desired, as an alternative design, a single weight member 714 and receptacle 710 combination may be provided, e.g., in the center rear, heel, or toe of the club head body 702.

In order to shift the club head 702 center of gravity 716 rearward (and increase the club head 702 moment of inertia), the weight member(s) 714 may be moved rearward from the recessed position shown in FIG. 7A to their extended position, as shown in FIG. 7B. The weight member(s) 714 may be mounted so as to move rearward in any desired manner without departing from the invention, such as by sliding, rotating, pivoting, detaching and reorienting, or otherwise moving with respect to the club head 702. As shown in FIGS. 7A and 7B, in this example structure 700, the weight member(s) 714 slide rearward to extend out of the groove(s), recess(es), or chamber(s) 710 and thereby change the overall exterior shape and appearance of the club head 702, move the center of gravity 716 rearward, and increase the club head 702 moment of inertia. If desired, a single weight member 714 may be designed to include plural "fingers" or "prongs" that extend into multiple independent grooves, recesses, or chambers 710 defined in the club head 702 (e.g., if desired, weight members 714 in FIGS. 7A and 7B may be connected to one another so as to form a single weight member structure).

Any desired manner of locking or holding the weight member(s) 714 at various locations with respect to the club head 702 (e.g., along the groove(s), recess(es), or chamber(s) 710) may be used without departing from this invention. As one example, element 720 in FIGS. 7A and 7B may represent a spring-loaded detent mechanism included with the weight member 714 that fits into one or more recess areas 722 provided on the chamber 710 walls. By pressing a release mechanism (e.g., a button on the exposed end of weight member(s) 714), the spring mechanism can release the detent structures to allow movement of the weight member(s) 714 within the groove(s), recess(es), or chamber(s) 710 (e.g., by sliding, etc.). Such spring-loaded detent mechanisms 720, their releasing mechanisms, and/or use of recesses 722 for securing two elements together are known and commercially available (e.g., used in coupling hydraulic lines to their fluid sources, coupling sockets onto ratchet wrenches, etc.). As another example, if desired, element 720 may represent a set screw that extends from an exterior of the club head body 702 to contact the weight member 714 (e.g., into a recess or opening formed in weight member 714) to hold the weight member 714 in place with respect to the club head body 702. Of course, other ways of holding the weight member(s) 714 in place may be used without departing from this invention, such as clamps, clasps, threaded arrangements, other mechanical connectors, friction fits, etc.

As additional or alternative potential features, if desired, the weight member 714 need not extend into the interior of the club head 702. Rather, it could slide along a groove or slot defined in or on the club head's exterior surface, such as along the sole member as illustrated in FIGS. 6A and 6B. As another potential option, if desired, when the weight member(s) is(are) at the extended position as shown in FIG. 7B, an additional weight or fill member may be inserted into the groove(s), recess(es), or chamber(s) 710 to at least partially fill them. Of course, a wide variety of other modifications, changes, additional structures, and/or combination of features are possible without departing from this invention.

Other features may be provided in club heads, if desired, in order to even more significantly affect the moment of inertia properties of the club head structure. For example, FIGS. 8A and 8B illustrate a golf club 800 having an overall structure similar to that shown in FIGS. 7A and 7B (in order to abbreviate the overall description that follows, the same reference numbers are used in FIGS. 8A and 8B to those used in FIGS. 7A and 7B when the corresponding parts may be the same or similar to those shown in FIGS. 7A and 7B). In this example club head structure 802, however, the weight members 714 are received in grooves, recesses, or chambers 810 that are oriented at acute angles away from the ball striking face 704 (e.g., toward the heel and toe areas of the club head 802). Openings 812 are provided in this example club head 802 to allow insertion and removal of weight members 714. By moving (e.g., sliding) the weight members 714 outward and away from the ball striking face 704 and locking them in place at this extended position, this action moves the center of gravity 716 of the club head rearward and significantly increases the club head 802 moment of inertia.

Again, any type of locking or securing mechanisms and/or other alternative and optional structures may be used in the club head structure 802 of FIGS. 8A and 8B, including the various systems, mechanisms, options, alternatives, etc. described above in conjunction with FIGS. 7A and 7B. Also, the weight member(s) 714 may be arranged in any manner, at any desired location(s), extend at any desired orientation or in any desired manner, and/or be provided in any desired numbers, without departing from this invention.

While FIGS. 4A through 8B generally illustrate driver or fairway wood-type club head structures, those skilled in the art will appreciate, of course, that these aspects of the invention may be included and practiced on any type of club head (e.g., irons, putters, etc.), including any type of wood-type club head, such as drivers, 2-woods through 13-woods, wood-type hybrid clubs, chipping or pitching clubs, and the like. The club heads may have any desired loft angles, lie angles, and/or other characteristics without departing from the invention.

III. Conclusion

In addition to iron and wood-type golf clubs (including hybrid type clubs), as described in detail above, aspects of this invention also may be used in conjunction with putter heads and putters. For example, rotatable and/or downwardly adjustable bridge or other structural members, e.g., of the types illustrated in FIGS. 1A through 3D, may be provided for use with a putter head without departing from the invention. As additional examples, if desired, slidable and/or rotatable weights and/or body members, e.g., of the types illustrated in FIGS. 4A through 8B, also may be provided on a putter head without departing from this invention. The adjustable weights and/or body members may be readily adjusted and/or secured in place with respect to the remainder of the golf club head in any desired manner, including the various manners described above. Of course, if desired, the various weight members (e.g., bridge member(s), movable weight(s), movable body member(s), etc.) may be included in any desired combination on a single club head structure (any type of club head structure) without departing from this invention.

Golf clubs and golf club heads in accordance with examples of the present invention also may be incorporated into a set, e.g., sets including one or more of woods, irons, hybrid type golf clubs, and/or putters. As more specific examples, aspects of the present invention may be used to provide a club set with increasing numbered woods and/or iron golf clubs, such as a driver and/or two or more of fairway woods, hybrid type clubs, a zero iron through a ten iron, various wedges (e.g., a pitching wedge, a lob wedge, a gap wedge, and a sand wedge, etc.), putters, etc. With at least some examples of the present invention, a golfer, a club designer, and/or a club fitter may select and/or modify the position and/or other properties of the adjustable weight(s), bridge member(s), and/or body member(s) for each golf club to meet the player's unique requirements, skill, or playing style. For each club in the set, the adjustable weight(s), bridge member(s), body member(s), and/or other features of the club head may progressively changed and/or positioned to alter the center of gravity of one club member with respect to the others in the set, to make the center of gravity better suited for use of the particular club, optionally customized for use by a specific golfer.

Moreover, while aspects of this invention may be particularly well suited for use by youngsters, beginners, or high handicappers (e.g., to help make the ball easier to hit, to make the ball fly straighter, to help get the ball airborne, to help eliminate ball flight problems (such as excessive fades, draws, hooks, or slices, etc.)), the clubs and club heads are not limited to use by these categories of players. At least some club heads and clubs that include features and aspects of the invention may be designed (e.g., as described above) to conform to the current USGA (or other) Rules of Golf (e.g., at least in their non-extended orientation). Therefore, players at any skill level and/or in any environment (e.g., in formal competitions, for handicapping purposes, etc.) may take advantage of clubs and club heads that incorporate features and aspects of the invention. Additionally, by providing mechanisms that allow easy changing of the weight members to and from their extended positions, the clubs and club heads may be transformed from a teaching aide or a beginner's club to fully conforming clubs and club heads (e.g., for use in formal competitions, for handicap purposes, as the player's game improves, etc.). In this manner, a player need not purchase a teaching or beginner set of clubs and then later be required to incur the added expense of purchasing a rule compliant club set.

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1-8B may be used individually and/or in any combination or subcombination without departing from this invention.

We claim:

1. A golf club head, comprising:

a club head body member having a ball-striking face, a rear surface behind the ball-striking face and a cavity defined in the rear surface; and a weight member engaged with the club head body member, wherein the weight member is movable between a first position, wherein at least a first portion of the weight member is located within the cavity, and a second position, wherein the first portion of the weight member is located outside the cavity to change an overall exterior shape of the club head;

wherein the weight member includes a bridge member engaged with a rear portion of an iron golf club head;

wherein the club head body member forms at least a portion of the iron golf club head; and wherein the first portion of the weight member is configured to move rearwardly away from the ball-striking face when the weight member moves from the first position to the second position.

2. A golf club head according to claim 1, wherein the weight member is rotatably engaged with the club head body member to move between the first position and the second position.

3. A golf club head according to claim 1, further comprising:

a securing system to hold the weight member in place with respect to the club head body member.

4. A golf club head according to claim 1, wherein at the second position, the weight member extends from the club head body member in a direction at least partially away from a front of the club head body member.

5. A golf club head according to claim 1, wherein the club head body member includes a raised boss element and the weight member includes a receptacle defined therein for receiving the first raised boss element.

6. A golf club head according to claim 5, wherein the iron golf club head is perimeter weighted around the rear portion of the club head body member and the raised boss element extends from a portion of a perimeter weighted structure, and the bridge member is engaged with the raised boss element.

7. A golf club head according to claim 1, wherein the weight member is movably engaged with the club head body member so as to be movable in a front-to-rear direction with respect to the club head body member.

8. A golf club head according to claim 1, wherein the first portion of the weight member is configured to move downwardly and rearwardly away from the ball-striking face when the weight member moves from the first position to the second position.

9. A golf club, comprising:

a club head body member having a ball-striking face, a rear surface behind the ball-striking face and a cavity defined in the rear surface;

a weight member engaged with the club head body member, wherein the weight member is movable between a first position, wherein at least a first portion of the weight member is located within the cavity and a second position, wherein the first portion of the weight member is located outside the cavity to change an overall exterior shape of the club head; and a shaft member engaged with the club head body member;

wherein the weight member includes a bridge member engaged with a rear portion of an iron golf club head;

wherein the club head body member forms at least a portion of the iron golf club head; and wherein the first portion of the weight member is configured to move rearwardly away from the ball-striking face when the weight member moves from the first position to the second position.

10. A golf club according to claim 9, wherein the weight member is rotatably engaged with the club head body member to move between the first position and the second position.

11. A golf club according to claim 9, wherein the first portion of the weight member is configured to move downwardly and rearwardly away from the ball-striking face when the weight member moves from the first position to the second position.

12. A golf club head, comprising:

a club head body member having a ball-striking face, a rear surface behind the ball-striking face, a perimeter weighting member extending rearwardly from the rear surface of the ball-striking face, and a rear cavity located behind the rear surface of the ball-striking face and defined at least partially by the perimeter weighting member and the rear surface of the ball-striking face; and a weight member engaged with the club head body member, wherein the weight member is movable between a first position, wherein at least a first portion of the weight member is located within the rear cavity, and a second position, wherein the first portion of the weight member is located outside the cavity to change an overall exterior shape of the club head;

wherein the weight member has a first end pivotably connected to the club head body member and a second end opposite the first end, wherein the first portion of the weight member is located at the second end, and the first portion is configured to move downwardly and rearwardly away from the ball-striking face when the weight member moves from the first position to the second position by pivoting at the first end.

* * * * *